US009412351B2

(12) United States Patent
Sapp et al.

(10) Patent No.: US 9,412,351 B2
(45) Date of Patent: Aug. 9, 2016

(54) PROPORTIONAL QUANTIZATION

(71) Applicant: APPLE INC., Cupertino, CA (US)

(72) Inventors: Markus Sapp, Appen-Etz (DE); Oliver Reichhardt, Klein Offenseth-Sparrieshoop (DE)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/503,359

(22) Filed: Sep. 30, 2014

(65) Prior Publication Data

US 2016/0093277 A1 Mar. 31, 2016

(51) Int. Cl.

| | |
|---|---|
| ***G10H 1/00*** | (2006.01) |
| ***G10H 1/28*** | (2006.01) |
| ***G10H 1/38*** | (2006.01) |
| ***G10H 7/00*** | (2006.01) |

(52) U.S. Cl.

CPC ..... *G10H 1/0066* (2013.01); *G10H 1/28* (2013.01); *G10H 1/38* (2013.01); *G10H 7/00* (2013.01); *G10H 2210/031* (2013.01); *G10H 2210/086* (2013.01); *G10H 2220/126* (2013.01); *G10H 2240/026* (2013.01)

(58) Field of Classification Search

CPC ..... G10H 1/28; G10H 7/00; G10H 1/0066; G10H 1/38; G10H 2210/086; G10H 2210/031; G10H 2220/126; G10H 2240/026

USPC ..... 84/645, 638

See application file for complete search history.

(56) References Cited

U.S. PATENT DOCUMENTS

| | | | | |
|---|---|---|---|---|
| 6,051,771 | A * | 4/2000 | Iizuka | G10H 1/28 84/622 |
| 8,153,882 | B2 * | 4/2012 | Adam | G10H 1/0066 84/609 |
| 8,618,404 | B2 * | 12/2013 | O'Dwyer | G10H 1/0008 84/603 |
| 9,105,260 | B1 * | 8/2015 | Helms | G10H 1/386 |

(Continued)

*Primary Examiner* — David Warren
*Assistant Examiner* — Christina Schreiber
(74) *Attorney, Agent, or Firm* — Kilpatrick Townsend & Stockton LLP

(57) ABSTRACT

A computer-implemented method includes receiving input data including MIDI events arranged in a timeline, determining a target grid position from among the plurality of grid positions, determining a search range around the target grid position, and identifying a set of MIDI events within the search range around the target grid position. The method further includes determining a reference point for the set of MIDI events based on a function of the set of MIDI events, adjusting a position of the reference point toward the target grid position, determining a proportional movement for each MIDI event on the timeline based on its location relative to the adjusted reference point, and adjusting each MIDI event based on the determined proportional movement. The function of the set of MIDI events can be a weighted average based on one or more MIDI characteristics of the set of MIDI events.

20 Claims, 10 Drawing Sheets

(56) References Cited

U.S. PATENT DOCUMENTS

2003/0066692 A1* 4/2003 Devige ..... G06F 3/0433 178/18.04
2006/0075887 A1* 4/2006 Shotwell ..... G10H 1/40 84/645
2006/0180007 A1* 8/2006 McClinsey ..... G10H 1/0008 84/645
2008/0072744 A1* 3/2008 Ito ..... G10H 1/28 84/638
2010/0132536 A1* 6/2010 O'Dwyer ..... G10H 1/0008 84/609
2011/0011246 A1* 1/2011 Buskies ..... G10H 1/0066 84/613
2012/0014673 A1* 1/2012 O'Dwyer ..... G06F 3/0346 386/282
2013/0233155 A1* 9/2013 Little ..... G10H 1/0016 84/609
2013/0340594 A1* 12/2013 Uemura ..... G10H 7/04 84/605
2014/0053710 A1* 2/2014 Serletic, II ..... G10H 7/00 84/609
2014/0140536 A1* 5/2014 Serletic, II ..... G06F 3/0481 381/98
2015/0013527 A1* 1/2015 Buskies ..... G10H 1/40 84/611
2015/0013528 A1* 1/2015 Buskies ..... G10H 1/0041 84/611
2015/0013532 A1* 1/2015 Adam ..... G10H 1/28 84/638
2015/0013533 A1* 1/2015 Buskies ..... G10H 1/0066 84/645

* cited by examiner

PROPORTIONAL QUANTIZATION

FIELD

Embodiments of the invention generally relate to software configured for editing MIDI-based musical performances. More specifically, aspects of proportional quantization in a musical performance are described herein.

BACKGROUND

Music editing applications allow music composers, media artists, and other users to create and edit a musical performance stored as Musical Instrument Digital Interface (MIDI) data. Users can import MIDI data files or compose musical pieces stored as MIDI data and use tools provided by the music editing application to edit the sequences of notes in the MIDI data. For example, a graphical user interface (GUI) of such a music editing application can allow users to modify one or more characteristics of the MIDI data, such as the pitch, position, timing, duration, and velocity (or "loudness") of the sequences of recorded notes in the MIDI files. Music editing can be performed on a digital audio workstation ("DAW"), GarageBand™ by Apple Inc., or any other suitable music editing applications that exist in hardware, software, firmware, or any combination thereof.

Music editing applications typically provide a musical grid and reference track (e.g., metronome click) that the performing musician will play to. Occasionally, the recorded sequence of MIDI note events will not match the grid position precisely. Often, this is caused by an intended groove, but sometimes the timing is simply inaccurate and the user may want to correct this imprecision without having to repeat the performance perfectly. However, some deviation from the grid might be desirable in certain cases to maintain the feel and expression of the original recording. For instance, a composer may wish to establish a strong ("tight") relationship between a kick drum sound (i.e., MIDI event) and quarter-note markers in the musical performance. Thus, quantization would be appropriate in this case to ensure that the position of any imprecise kick drum MIDI event is corrected accordingly. On the other hand, certain musical techniques or performances include subtle dynamics, flurries, or other musical characteristics (e.g., quickly arpeggiated piano chords, drum flams, or drum rolls), resulting in a succession of notes that can be positioned very close together. Thus, typical quantization algorithms would be detrimental to these performances as many of the notes would be pushed to overlapping positions or the relationship of the notes' placement with respect to one another would be significantly changed, resulting in unintended and often unpleasant musical arrangements.

In summary, a significant downside of common quantization algorithms is that they do not properly maintain musically intended deviations from the grid, but force note positions exactly onto the grid, thus destroying any musical feel or playing detail beyond the grid resolution. While reducing quantize strength to values below 100% may keep some deviations intact to some degree, things like flams, quick arpeggios or grace notes, etc., are still compressed in time and lose their intended effect. Thus, there is a need for improved quantization algorithms to address these problems.

BRIEF SUMMARY

Certain embodiments of the invention relate to a method of proportional quantization that can to correct imperfections in the timing of MIDI events in an arrangement, while still maintaining the relationship of MIDI events with respect to one another. In a simplified embodiment, the method includes identifying a number of target positions within a grid. The target position identifies a point that adjacent MIDI events (e.g., MIDI notes) will be moved toward when quantization is applied. Each target position has a defined search range that defines an area around a target position. In some cases, a "center of gravity," can be an average position of the MIDI events contained within each search range, which can be referred to as a "reference point." The average position can be based on a number of MIDI characteristics for each MIDI event including, but not limited to, a position and velocity (i.e., "loudness"). The reference point is then quantized or moved toward the corresponding target position by a predetermined amount and the associated MIDI events in that particular search range are moved accordingly. Thus, the reference point can be quantized to precise positions in a grid, while maintaining the relationship of the corresponding MIDI events associated therewith. MIDI events outside of the search ranges can also be affected by adjacent quantization events, as further discussed below.

According to certain embodiments, a computer-implemented method includes receiving input data including MIDI events arranged in a timeline, determining a target grid position from among the plurality of grid positions, determining a search range around the target grid position, and identifying a set of MIDI events within the search range around the target grid position. The method can further include determining a reference point for the set of MIDI events based on a function of the set of MIDI events, adjusting a position of the reference point toward the target grid position, determining a proportional movement for each MIDI event on the timeline based on its location relative to the adjusted reference point, and adjusting each MIDI event based on the determined proportional movement. The function of the set of MIDI events can be a weighted average based on one or more MIDI characteristics of the set of MIDI events.

In some implementations, the MIDI characteristics include one or more of a MIDI event velocity and a MIDI event position relative to its corresponding reference point. The reference point may be adjusted toward the target grid position based on a quantization strength. In some cases, the method can further include receiving quantization data indicating a desired quantization strength, and setting the quantization strength based on the quantization data. Certain embodiments may further comprise determining a second target grid position from among the plurality of grid positions, determining a second search range around the second target grid position, identifying a second set of MIDI events within the search range around the second target grid position, and determining a second reference point for the second set of MIDI events, where the second reference point corresponds to a function of the second set of MIDI events. The method may further include adjusting a position of the second reference point toward the second target grid position, where determining a proportional movement for each MIDI event on the timeline is further based on its location relative to the second reference point. Events can be moved to any location on the timeline, as dictated by the quantization algorithm. For instance, some events may be moved to a grid line, between grid lines, or overlap grid lines, as would be appreciated by one of ordinary skill in the art.

BRIEF DESCRIPTION OF THE DRAWINGS

The disclosure will be readily understood by the following detailed description in conjunction with the accompanying drawings. It should be understood that while the following figures and associated detailed description provide a number of illustrative embodiments to explain various aspects of the present invention, it should be understood that the specific examples are not limiting and concepts described in one embodiment of the invention can be modified and/or applied to any other embodiment or concept described herein. The accompanying drawings include.

DETAILED DESCRIPTION OF THE INVENTION

Figure 1A:
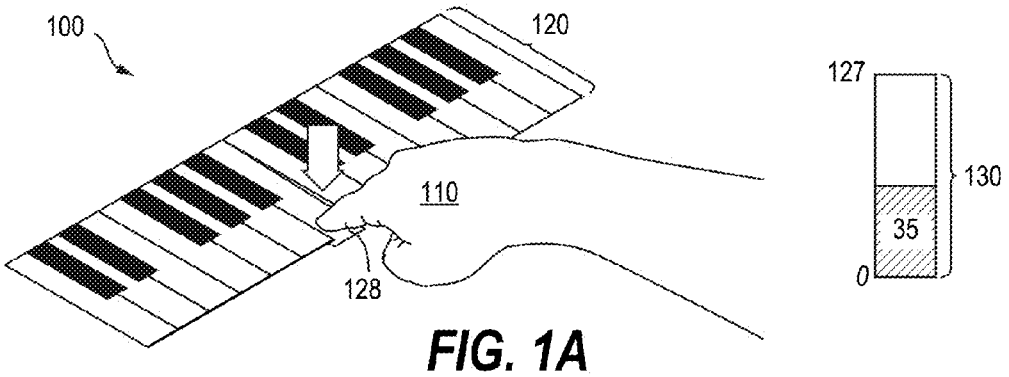
FIG. 1A depicts certain aspects of MIDI characteristics, according to certain embodiments of the invention.

Embodiments of the invention generally relate to software configured for editing MIDI-based musical performances. More specifically, aspects of proportional quantization in a musical performance are described herein.

Certain embodiments of the invention relate to a method of proportional quantization that can to correct imperfections in the timing of MIDI events in an arrangement, while still maintaining the relationship of MIDI events with respect to one another. In a simplified embodiment, the method includes identifying a number of target positions within a grid. The target position identifies a point that adjacent MIDI events (e.g., MIDI notes) will be moved toward when quantization is applied. Each target position has a defined search range that defines an area around a target position. In some cases, a "center of gravity," can be an average position of the MIDI events contained within each search range, which can be referred to as a "reference point." The average position can be based on a number of MIDI characteristics for each MIDI event including, but not limited to, a position and velocity (i.e., "loudness"). The reference point is then quantized or moved toward the corresponding target position by a predetermined amount and the associated MIDI events in that particular search range are moved accordingly. Thus, the reference point can be quantized to precise positions in a grid, while maintaining the relationship of the corresponding MIDI events associated therewith. MIDI events outside of the search ranges can also be affected by adjacent quantization events, as further discussed below.

MIDI Capture and Editing

Music editing applications allow music composers, media artists, and other users to create and edit a musical performance stored as Musical Instrument Digital Interface (MIDI) data. Users can import MIDI data files or compose musical pieces stored as MIDI data and use tools provided by the music editing application to edit the sequences of notes (i.e., MIDI events) in the MIDI data. For example, a graphical user interface (GUI) of such a music editing application can allow users to modify one or more characteristics of the MIDI events, such as the note number, pitch, position, timing, duration, and velocity (or "loudness") of the sequences of recorded notes in the MIDI files. In many cases, the recording device/software will provide some kind of musical grid and metronome click to which the performing musician will play. Typically, the recorded MIDI note events will not match the grid position precisely. Often, this is caused by an intended groove, but sometimes the timing is simply inaccurate and the user may want to correct this imprecision without having to repeat the performance perfectly. However, some deviation from the grid might be desirable in certain cases to maintain the feel and expression of the original recording.

To illustrate, a composer may wish to establish a strong ("tight") relationship between a kick drum sound (i.e., MIDI event) and quarter-note markers in the musical performance. Thus, quantization would be appropriate in this case to ensure that the position of any imprecise kick drum MIDI event is corrected accordingly. On the other hand, certain musical techniques or performances include subtle dynamics, flurries, or other musical characteristics (e.g., quickly arpeggiated piano chords, drum flams, or drum rolls), resulting in a succession of MIDI events that can be positioned very close together. Thus, typical quantization algorithms would be detrimental to these performances as many of the MIDI events would be pushed to overlapping positions or the relationship of the MIDI events' placement with respect to one another would be significantly changed, resulting in unintended and often unpleasant musical arrangements.

Some typical parameters of quantization functionality can include grid resolution, quantization strength, quantization range, and quantization swing. Grid resolution can refer to how the grid is divided with respect to timing. For example, a grid can be divided into 1/16 notes, 1/32 notes, 1/64 notes, or other suitable resolution. Quantization strength typically defines what percentage of timing correction (i.e., quantization) is applied. Quantization range typically defines the catch range around a grid position in which events will be affected by the quantization. For example, a MIDI event (e.g., kick drum) close to a grid position may be moved or "snapped" to that grid position, while other MIDI events farther from the grid position may remain unchanged. Finally, quantization swing can include modifying grid positions on offbeats to achieve a swing feeling.

MIDI Characteristics

MIDI characteristics can include any number of performance characteristics that define how a musical element is played (or not played). For example, performance characteristics can include velocity data, note data (e.g., note type, rest type, note ties, etc.), rhythmic order data, timing data, pitch data, or any type of data that can characterize aspects of the performance, as would be appreciated by one of ordinary skill in the art with the benefit of this disclosure. In some cases, MIDI characteristics can be referred to as MIDI performance data.

Velocity is one type of musical performance data that can be described as the speed or force with which the key is being played. In a MIDI input device (e.g., keyboard), the harder a key is played, the higher the velocity value is registered. Similarly, the softer the key is played, the lower the velocity value. In MIDI, velocity is typically measured on a scale from 0 to 127, with 127 being the highest value that can be registered. It would be understood by one of ordinary skill in the art that any range of values, MIDI or otherwise, can be used to represent key velocity values.

FIG. 1A illustrates aspects of musical performance data 100, according to certain embodiments of the invention. FIG. 1A includes a keyboard 120 (e.g., MIDI keyboard) with a number of keys. A user 110 is depressing key 128 softly (i.e., at a low velocity). The velocity bar 130 indicates a velocity of 35 out of 127, which can be a relatively low.

Figure 1B:
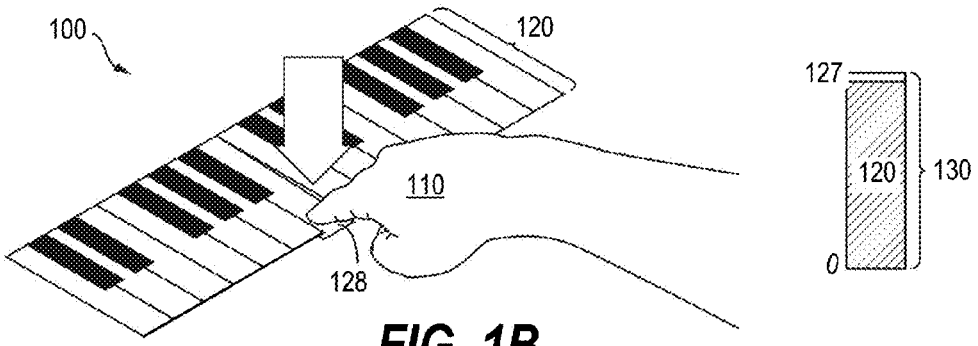
FIG. 1B depicts certain aspects of MIDI characteristics, according to certain embodiments of the invention.

FIG. 1B illustrates aspects of musical performance data 100, according to certain embodiments of the invention. FIG. 1B includes a keyboard 120 (e.g., MIDI keyboard) with a number of keys. A user 110 is depressing key 128 very hard and/or fast. The velocity bar 130 indicates a velocity of 120 out of 127, which is a relatively high velocity (i.e., a hard key press). Although FIGS. 1A and 1B depict a user depressing key 128 at a certain velocity, key presses can be automated and may include any velocity that is predetermined, real-time generated, etc.

Figure 2:
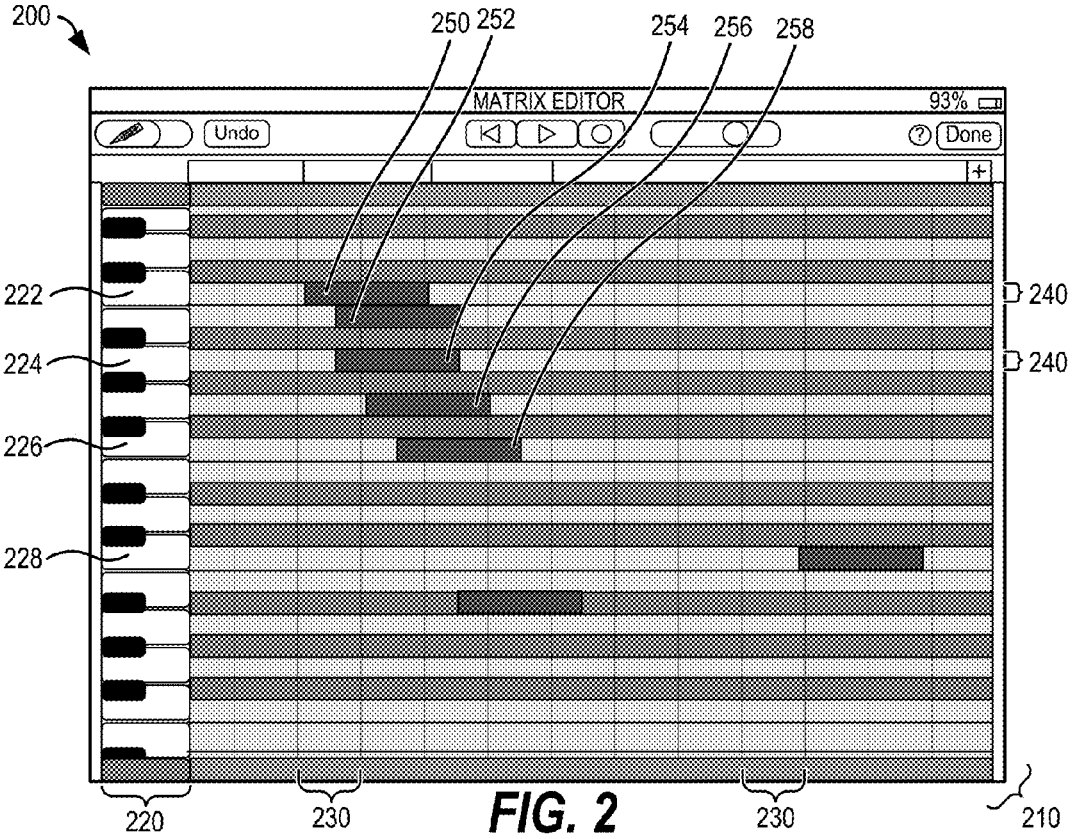
FIG. 2 depicts a matrix editor for editing a MIDI performance, according to certain embodiments of the invention.

FIG. 2 depicts a music editing application 200 for editing MIDI events in a MIDI performance, according to certain embodiments of the invention. Music editing application 200, or the "matrix editor" displays a GUI that includes a number of display areas such as a matrix grid 210, a vertical and virtual keyboard 220, among other features. Keyboard 220 includes a number of keys (e.g., keys 222, 224, 226, 228). Matrix 210 includes a number of rows 240 and column 230, with a number of MIDI events (250, 252, 254, 256, 258) configured in a particular arrangement. Music editing applications can include piano roll editors, step-wise sequencers, step editors, or the like.

MIDI events, in this example, are represented by a series of horizontal rectangles or blocks aligned on matrix grid 210 including horizontal (240) and vertical (230) lines representing time parameters and musical pitch parameters, respectively. The horizontal placement of note events indicates their temporal (e.g., bar, beat, and sub-beat) positioning within the region. The length of the rectangle in matrix grid 210 is directly proportional to the MIDI event length. The vertical position of MIDI events indicates their respective pitch, with those nearer the top of matrix grid 210 being higher in pitch. Chords are displayed as a vertical stack of MIDI event rectangles.

In this example, matrix editor 210 also includes a vertical keyboard 220 on the left side of matrix grid 210 that indicates MIDI event pitches. As shown, horizontal black lines run across matrix grid 210 to enable the user to easily transpose notes by dragging them up or down the horizontal rows 240. Although a piano-type matrix editor is shown in this example, a user can select a different type of matrix editor for different types of instruments, such as a string-type or guitar-type matrix editor. In such embodiments, instead of vertical keyboard 220, the matrix editor can display a vertical guitar/string fret board, a string neck, a guitar neck, or other suitable style of user interface.

Matrix editor 200 also includes tools to facilitate the editing process, including moving MIDI events, adding events, deleting events, changing MIDI characteristics of MIDI events (e.g., changing pitch (vertical movement), changing time position (horizontal movement), changing duration, changing velocity, etc.), and the like. Those of ordinary skill in the art with the benefit of this disclosure would appreciate the editing capabilities provided by matrix editor 200.

FIGS. 3-9 illustrate certain aspects of the invention on a time line, rather than a grid matrix, as shown in FIG. 2. These simplified representations are utilized for the purpose of presenting the concepts provided herein in a simple, clear, and concise manner. It should be understood that although MIDI events may be entered, edited, arranged, etc., in a number of ways that may differ from the representations shown in FIGS. 2-9, those of ordinary skill in the art with the benefit of this disclosure would understand that the concepts provided herein can be applied to any interface configured for MIDI editing, composition, and the like.

Figure 3:
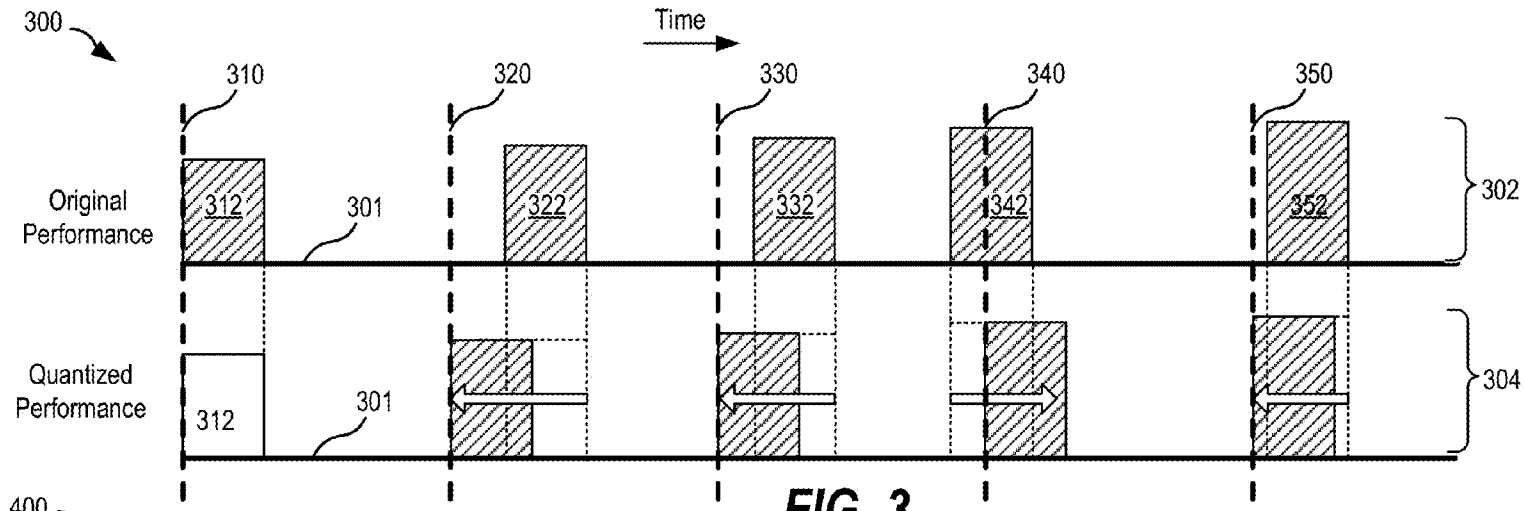
FIG. 3 illustrates certain aspects of quantization, according to certain embodiments of the invention.

FIG. 3 depicts a graph 300 illustrating certain aspects of quantization in a musical arrangement. More specifically, graph 300 illustrates how a typical quantization process can affect MIDI events in a musical arrangement. Graph 300 includes an original performance 302 and a quantized performance 304, each populated by a number of MIDI events (312, 322, 332, 342, 352) positioned on a timeline 301. MIDI events can trigger or be associated with any type of sound or sample (e.g., audio, video, effect, etc.), and in any suitable format (e.g., .mp3, .wav, etc.). MIDI events may be referred to herein simply as "events." Those of ordinary skill in the art would appreciate the many types of MIDI events and file formats that can be used in a MIDI editing tool (e.g., MIDI matrix editor). Timeline 301 is divided by a number of equally-spaced target grid positions (310, 320, 330, 340, 350) to provide a timing reference, which are represented by dashed or broken vertical lines. In practice, a metronome is often used to provide audible "clicks" to provide a user with a sense of timing and is typically synched with the timing references. Each target grid position ("target position") can be set according to a musical time unit (e.g., quarter note, eighth note, sixteenth note, etc.), standard time unit (e.g., seconds, millisecond, etc.), or other suitable unit of musical time division. In this non-limiting example, the target grid positions identify quarter notes.

In this particular example, each of the MIDI events are kick drum samples. In a musical performance, the kick drum may provide a reference beat that other instruments in an arrangement are synchronized to. Thus, it may be important for a kick drum to have consistent timing to ensure that all of the instruments are in synch. Original performance 302 includes a series of kick drums (MIDI events 322, 332, 342, 352) that are poorly aligned with their corresponding target grid positions. This may occur, for example, as a result of a live-capture performance by an inexperienced musician. MIDI events 322, 332, and 352 are triggered after their corresponding target grid position by varying amounts, while MIDI event 342 is triggered prior to its corresponding target grid position. Quantizing the MIDI events can be advantageous, as shown in this case, to ensure that the reference beat (i.e., kick drums) is accurate, consistent, and reliable. An example of a resultant quantized performance 304 is shown directly below the original performance.

Referring to FIG. 3, event 312 is aligned with target position 310, thus no quantization (i.e., movement) is applied.

Event 322 is triggered after target position 320, thus a quantization is applied, moving event 322 so that it is aligned with target position 320. Similarly, events 332 and 352 are quantized to align their corresponding trigger points (i.e., the beginning of the sample) to target positions 330 and 350, respectively. Event 340 was triggered prior to its corresponding target position, so the quantization process moves its trigger point forward in time to align with target position 340. It should be noted that although this particular example shows MIDI events being quantized (i.e., shifted in time) by varying amounts, the amount of quantization (i.e., quantization strength) or the range that quantization is applied (i.e., search range) can change the resulting positions of each MIDI event. For example, some MIDI events may fall outside of a predetermined search range such that a the quantization process does not affect their position. Even if a MIDI event falls within a predetermined range, the quantization strength may be too low to move the trigger point of the MIDI event all the way to the target position. These parameters and their ramifications are further discussed below. Despite the advantages that common quantization algorithms can provide as a composition tool, there can also be anamolous and unintended effects in certain situations, as demonstrated in FIG. 4.

Figure 4:
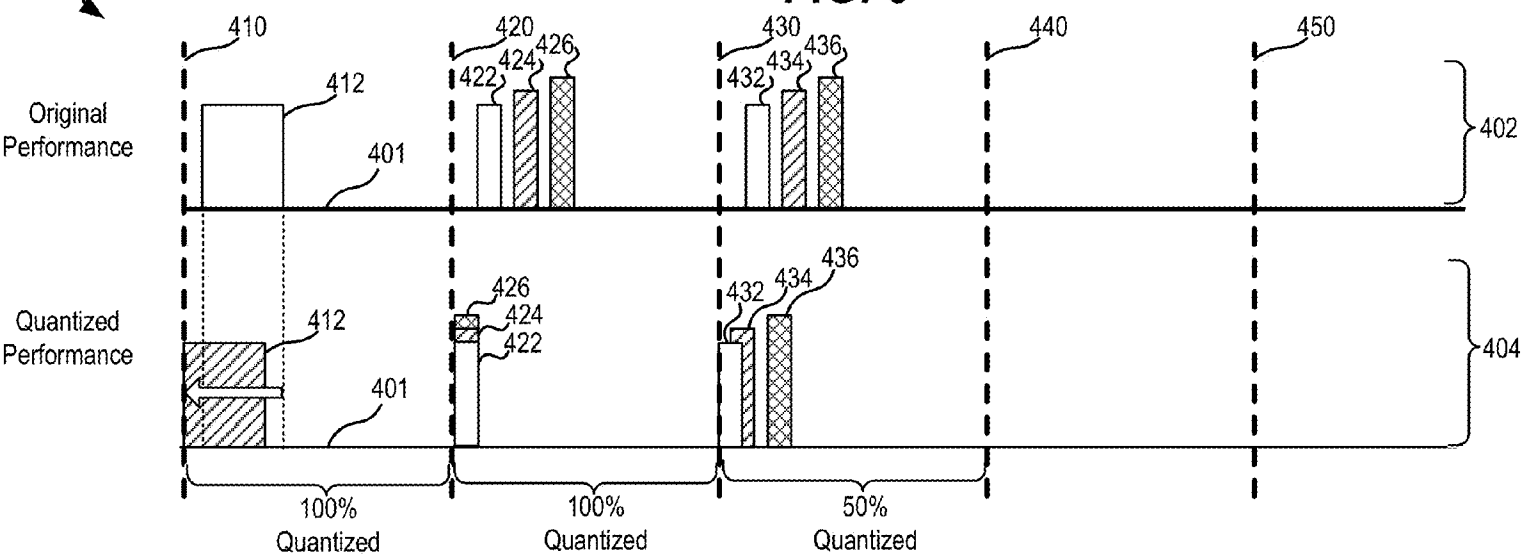
FIG. 4 illustrates certain aspects of quantization, according to certain embodiments of the invention.

FIG. 4 illustrates certain deleterious effects that can be caused by typical quantization algorithms. Graph 400 depicts an original performance 402 and a quantized performance 404 populated by a number of MIDI events (412, 422, 424, 426, 432, 434, 436) positioned on a timeline 401. MIDI events can include any type of sample, effect, or other suitable input, as would be appreciated by one of ordinary skill in the art. Timeline 401 is divided by a number of equally-spaced target grid positions (410, 420, 430, 440, 450) to provide a timing reference, which are represented by dashed or broken vertical lines. Each target grid position ("target position") can be set according to a musical time unit, standard time, or other suitable unit of musical time division. In this non-limiting example, the target grid positions identify quarter notes.

In this example, a kick drum sound (MIDI event 412) and a number of snare drum sounds (MIDI events 422, 424, 426, 432, 434, 436) are placed on time line 401. A first set of snare samples includes a snare triplet comprising events 422, 424, and 426. A second set of snare samples includes a snare triplet comprising events 432, 434, and 436. A 100% quantization strength is applied to the kick drum sample (event 412) and the first set of snare drum samples (events 422, 424, 426). A 50% quantization strength is applied to the second set of snare drum samples (events 432, 434, 436). The intended outcome of the musical performance is to play the kickdrum on a quarter note marker (i.e., target position 410) and the first note of each snare triplet on their corresponding marker (i.e., target positions 420, 430), while still maintaining the positional relationship of each event in the snare drum triplet. As shown in original performance 402, the kick drum and snare samples are poorly aligned with their corresponding target grid positions. In this example, the result of the application of a typical quantization algorithm results in unintended effects, as illustrated in the resultant musical arrangement of quantized performance 404.

Referring to FIG. 4, event 412 is triggered after target position 410 and quantization is applied to cause event 322 to move such that its trigger point (left side of MIDI event) coincides with target position 410. Thus, event 412 is aligned with target position 410 and the kick drum sounds "in time" or "on the beat," as would likely be intended when applying a quantization algorithm.

Each event of the first snare triplet (events 422, 424, and 426) is triggered after target position 420. This example illustrates how applying a conventional quantization process can lead to unintended results. Each event 422, 424, 426 has a different velocity, which is represented as an amplitude (i.e., height of bar). Each event 422, 424, 426 is quantized at 100% quantization strength and is aligned with target position 420. Thus, each event 422, 424, 426 loses its spacing relative to one another such that the snare triplet becomes a single event having three overlapping velocities. That is, the positional relationship between each event in the triplet is lost due to quantization.

In this example, events 412 and 422-426 are quantized at 100%, however the actual range of a quantization algorithm can vary. For example, 100% quantization in one MIDI editor may span a first range or threshold, while a different MIDI editor may have a range different from the first range. The range can be defined by a unit of time (e.g., milliseconds), beat denominations (e.g., 1/16 notes), or other suitable unit of measurement, as would be appreciated by one of ordinary skill in the art. For the sake of simplicity, that actual threshold from target position 420 at 100% quantization is not specified in FIG. 4.

Each event of the second snare triplet (events 432, 434, 436) is triggered after target position 430. This example illustrates how applying a conventional quantization process, even with a reduced quantization strength, may still lead to unintended results. Each event 432, 434, 436 in original performance 402 has a different velocity. Since the quantization strength is 50%, each event 432, 434, 436 is quantized by a smaller amount then the first snare triplet (at 100% quantization strength). Although the events do not shifted as much, the relationship between events 432, 434, 436 is changed, as shown in 404. Thus, quantization can be a useful tool for improving the timing of a musical performance, but conventional methods can distort the positional relationship between proximate events.

Proportional Quantization

The following figures (FIGS. 5-10) illustrate aspects of proportional quantization. Proportional quantization can provide the benefit of timing corrections (i.e., time shifting to a target grid position), while maintaining the timing relationship between adjacent MIDI events.

Figure 5:
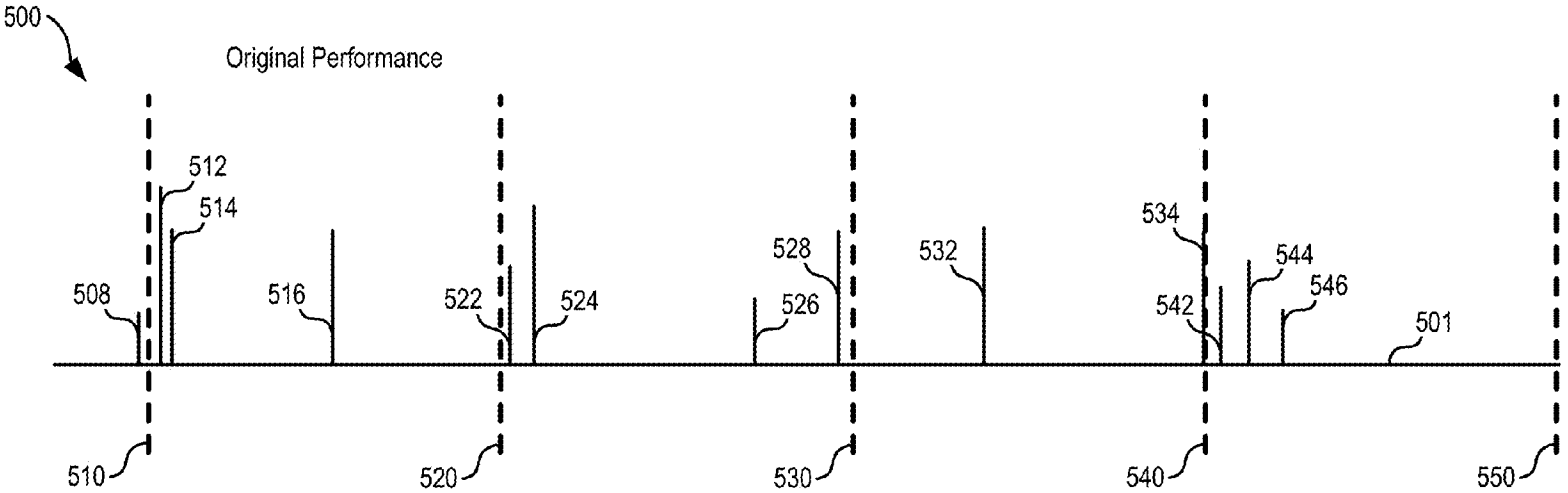
FIG. 5 illustrates certain aspects of proportional quantization, according to certain embodiments of the invention.

FIG. 5 illustrates a graph 500 of an original performance populated by a number of MIDI events (508, 512, 514, 516, 522, 524, 526, 528, 532, 534, 542, 544, 546) positioned on a timeline 501. MIDI events can include any type of sample, effect, or other suitable input, as would be appreciated by one of ordinary skill in the art. Timeline 501 is divided by a number of equally-spaced target grid positions (510, 520, 530, 540, 550) to provide a timing reference, which are represented by dashed or broken vertical lines. Each target grid position ("target position") can be set according to a musical time unit, standard time, or other suitable unit of musical time division. In some cases, target grid positions can be set to different time divisions throughout a performance. For example, target grid positions can be set to quarter notes for one section, and eighth notes for another section. Target grid positions may be uniformily distributed (e.g., quarter note spacing) or asymmetrically distributed (e.g., quarter note spacing followed by dotted half note spacing). In some implementation, target grid positions can be manually generated (e.g., determined/selected by a user) or automatically generated and can be placed in any suitable configuration or distribution, as would be appreciated by one of ordinary skill in the art.

Each of the MIDI events has a corresponding velocity. In FIG. 5, the height of each MIDI event corresponds to it velocity. Other MIDI characteristics can be associated with each MIDI event (e.g., pitch, performance attributes, effects, etc.), as discussed above. Referring to graph 500, the original performance includes a plurality of MIDI events arranged along timeline 501. Many of the MIDI events were poorly executed and do not line up with the target grids. As a result, the performance will sound "off" That is, certain notes (e.g., kick drums, snares, instruments, etc.) will sound too late or too early, which can be easily detected, even by non-musicians. As such, the timing of the performance will be corrected using "proportional quantization," resulting in a musically "tight" arrangement that is aligned with the beat, while maintaining the timing relationship between adjacent or closely positioned MIDI events on timeline 501.

Figure 6:
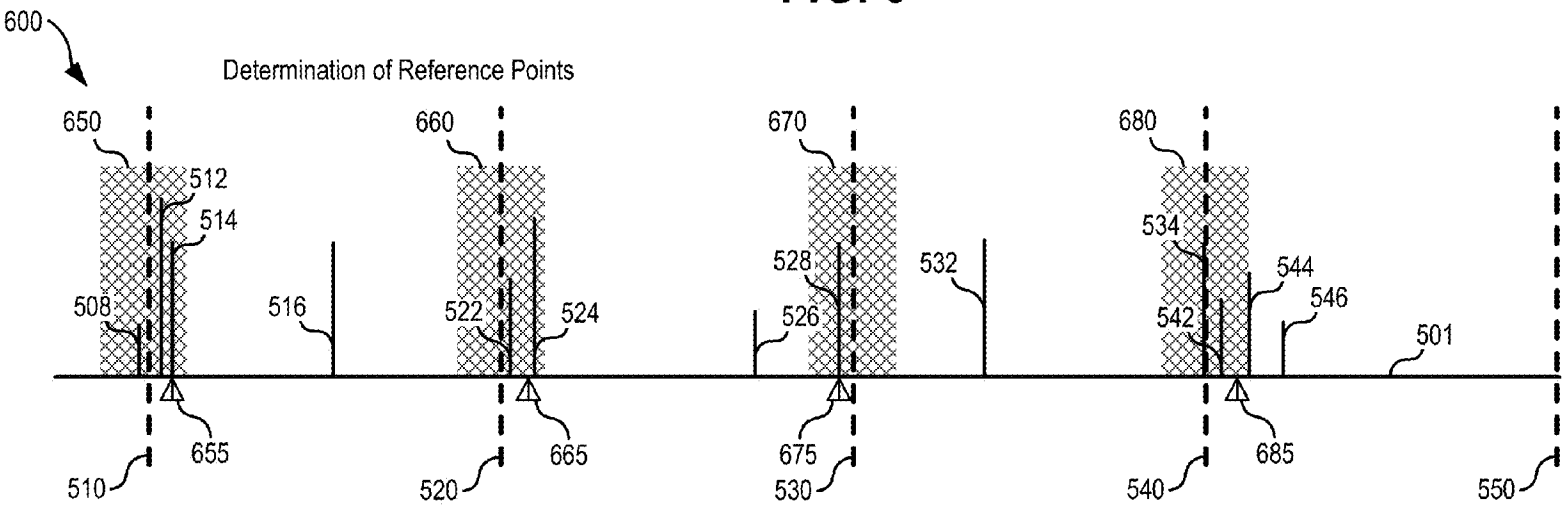
FIG. 6 illustrates certain aspects of determining reference points in proportional quantization, according to certain embodiments of the invention.

FIG. 6 illustrates certain aspects of determining reference points in proportional quantization, according to certain embodiments of the invention. Reference points can be used to determine a proportional quantization amount of a group of MIDI events within a quantization range, as further discussed below. FIG. 6 includes the original performance of FIG. 5 on timeline 501, including MIDI events (508, 512, 514, 516, 522, 524, 526, 528, 532, 534, 542, 544, 546), as well target grid positions (510, 520, 530, 540, 550), which are represented by dashed or broken vertical lines. FIG. 6 further includes quantization ranges (650, 660, 670, 680) and reference points (655, 665, 675, 685).

A quantization range ("range") is a set bounded area that a quantization algorithm is applied to, according to certain embodiments of the invention. The bounded area, or "width" of each range can be any suitable amount. Wider ranges will quantize MIDI events that span a wider area on timeline 501 than narrower ranges, and vice versa.

Referring to FIG. 6, each range is symmetrically positioned around a corresponding target grid position. For example, range 650 is symmetrically positioned with respect to target grid position 510. Similarly, range 660 is symmetrically positioned with respect to target grid position 520. Ranges can be positioned or arranged in any suitable fashion. For instance, some ranges may differ in width from one target position to the next, ranges may not be positioned on every consecutive target position, ranges may be asymmetrically positioned with respect to target positions, and the like, as would be appreciated by one of ordinary skill in the art.

In some embodiments, a reference point represents a "weighted average" of any MIDI events positioned within a quantization range. Referring to FIG. 6, reference point 655 is the weighted average of MIDI events positioned within range 650 (i.e., MIDI events 508, 512, and 514). Similarly, reference point 665 is the weighted average of MIDI events 622 and 624, which are positioned within range 660. Furthermore, reference point 675 is the weighted average of MIDI events 628, which is positioned within range 670, and reference point 685 is the weighted average of MIDI events 534, 542, and 544, which are positioned within range 680.

The reference point, or weighted average, can be determined in a number of ways. For example, the weighted average may be determined based on the relative positions of the MIDI events, the relative velocity (or other suitable characteristic) of each MIDI event, or any combination thereof, as would be appreciated by one of ordinary skill in the art with the benefit of this disclosure.

Referring to FIG. 6, the reference points are based on the weighted average of the relative position and relative velocity of each MIDI event within their corresponding quantization range. To illustrate, two MIDI events of equal velocity that are symmetrically positioned on either side of a corresponding target position would result in a reference point positioned on top of the corresponding target position. If the right MIDI event (positioned after the corresponding target position on timeline 501) had a greater velocity than the left MIDI event (positioned before the corresponding target position on timeline 501), then the reference point would be skewed to the right of the target position. Similarly, if the left MIDI event had a greater velocity than the right MIDI event, the reference point would be proportionally skewed to the left. In the same example, if the two MIDI events had the same velocity, but the right MIDI event was positioned at a farther distance from the target position but still within the corresponding range, then the reference points would be proportionally skewed to the right, and vice versa.

Referring to target position 510, one relatively low velocity MIDI event 508 is positioned prior to target position 510 in quantization range 650, while two relatively high velocity MIDI events 512, 514 are positioned after target position 510. As a result, reference point 655 is positioned between the location of MIDI events 512, 514 because they have a significantly higher velocity than MIDI event 508 and therefore reference point 655 is skewed to the right of target position 510.

Referring to target position 530, only one MIDI event 528 is located within the corresponding quantization range 670. Thus, the resulting reference point 675 is positioned in the same location as MIDI event 528 since the calculation for the average position and velocity does not factor in any other MIDI events. The weighted averaging principle is applied to the remaining quantization ranges shown in FIG. 6.

Figure 7:
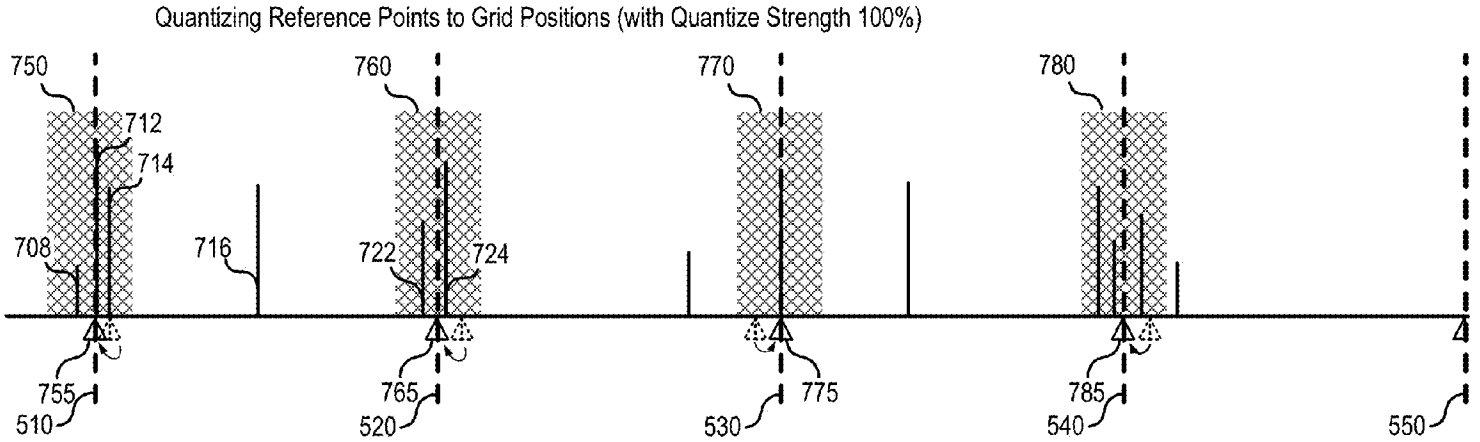
FIG. 7 illustrates certain aspects of quantizing reference points to grid positions in proportional quantization, according to certain embodiments of the invention.

FIG. 7 illustrates certain aspects of quantizing reference points to grid positions by using proportional quantization, according to certain embodiments of the invention. In this example, each MIDI event is quantized such that their positional relationship with respect to one another is proportionally maintained. That is, each MIDI event is proportionally moved based on its location relative to a reference point and the amount of movement of that reference point. Some MIDI events may move farther than others. For instance, a MIDI event positioned next to a reference point may be heavily influenced by its movement and its movement will be proportioned accordingly. Conversely, a MIDI event may be far removed from a reference point and will be influenced very little by its movement, resulting in very little movement. The proportional movement can be compared to the movement of certain locations on a stretching rubber band, as further described below with respect to FIG. 10. Typically, the movement of a MIDI event will be based on two reference points positioned adjacent to the MIDI event (before and after on a timeline). For example, a MIDI event positioned relatively close to a first reference point and relatively far from a second reference point will move proportionally based on an amount of movement of each reference point and the position of the MIDI event with respect to each reference point. In FIG. 7, all MIDI events are influenced by their adjacent reference points. In some implementations, only the MIDI events within a quantization range are affected. Other quantization rules regarding the treatment of MIDI events during a quantization process can be set according to preference.

In a second embodiment, the group of MIDI events within each corresponding quantization range is quantized, but the MIDI events maintain their positional relationship with respect to one another. That is, the spacing between each MIDI event located within their corresponding quantization range is maintained, while the group of MIDI events as a whole are shifted towards the corresponding target position. More specifically, the reference point, which represents the average of the MIDI events within their corresponding quantization range, is moved toward the target position. For the sake of clarity, one could imagine the group of MIDI events fixed on a slide rule, where the group of MIDI events are shifted toward the target position based on the position of the reference point and the quantization strength.

The amount that the reference point is moved corresponds to the quantization strength. In this particular example, the quantization strength is set to 100%, but any suitable quantization can be used. Thus, in each embodiment, the articulation and timing of the individual MIDI events are maintained (e.g., a rapid fire snare roll), while still receiving the benefit of the timing correction by aligning the group of MIDI events as a whole with their corresponding target position. Consequently, MIDI events are quantized based on their weighted average and, as a result, the MIDI events sound "in time" or "in the pocket," yet their relative placement with respect to the other MIDI events remains intact. This resolves the problems associated with conventional quantization methods and provides a very powerful musical correction tool with varied uses. It should be noted that although the figures described herein include MIDI events, the quantization concepts can be applied to other applications, as would be appreciated by one of ordinary skill in the art.

FIG. 7 includes target grid positions (510, 520, 530, 540, 550) and quantization ranges (750, 760, 770, 780). Each reference point (755, 765, 775, 785) is quantized and moved toward its corresponding target position. Reference point 755 has been moved from its position in FIG. 6 (reference point 655) to target position 510. Thus, reference point 755 and its corresponding group of MIDI events 708, 712, 714 are proportionally quantized to target position 510, but generally maintain their positional relationship with respect to one another. Similarly, reference point 765 has been moved from its position in FIG. 6 (reference point 665) to target position 520. Thus, reference point 765 and its corresponding group of MIDI events 722, 724 are proportionally quantized to target position 520, but generally maintain their positional relationship with respect to one another. Although it appears that the MIDI events have not changed their distance with respect to one another, it should be understood that each MIDI event is moved based on its own particular distance to a reference point and small changes in the spacing between MIDI events will result. Thus, the relationship between MIDI events is "generally" maintained, but differences will occur. However, the musical characteristics of the performance remain intact for all practical purposes (i.e., small deviations in distance between notes may not be noticeable to the listener).

In each case, the reference points are quantized and aligned with their respective target positions. Each of the MIDI events associated with a reference point (or reference points) is also quantized and moved accordingly, but their resulting position may or may not be aligned with the target position. In some implementations, a compression algorithm can be applied, which can change the relative position of each MIDI event with respect to one another and with respect to the reference point. This is further discussed below with respect to FIG. 9.

Figure 8:
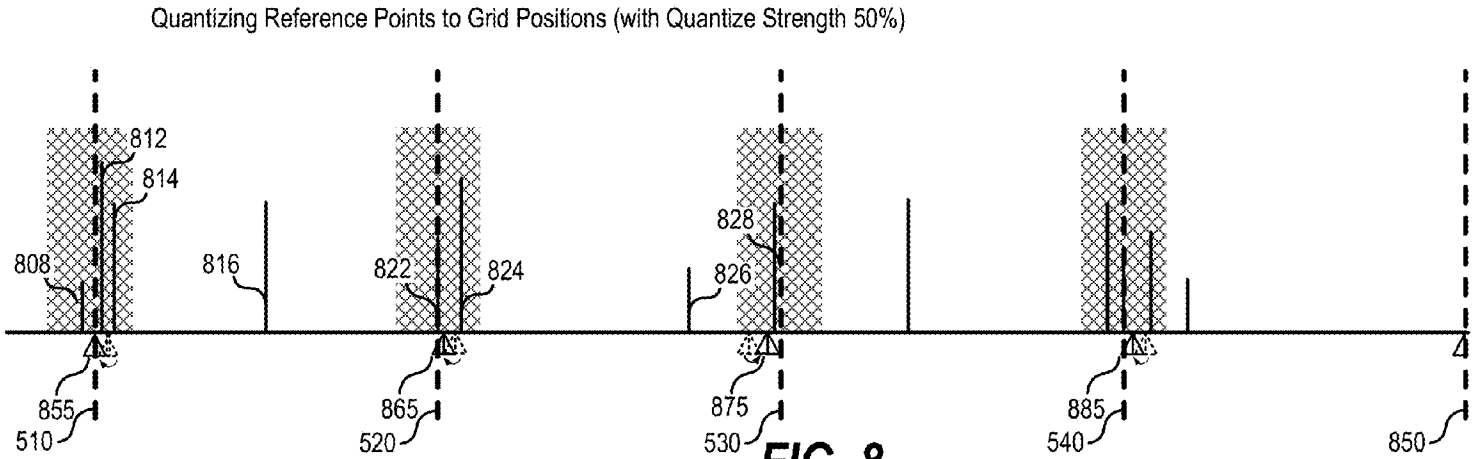
FIG. 8 illustrates certain aspects of quantizing reference points to grid positions in proportional quantization, according to certain embodiments of the invention.

FIG. 8 illustrates certain aspects of quantizing reference points to grid positions by using proportional quantization, according to certain embodiments of the invention. In this example, the quantization strength is set to 50%. Each reference point (855, 865, 875, 885) is quantized and moved to its corresponding target position. Reference point 855 has been moved from its position in FIG. 6 (reference point 655) to target position 510. Thus, reference point 855 and its corresponding group of MIDI events 808, 812, 814 (and to a lesser extent, MIDI event 816) are quantized to target position 510, but generally maintain their positional relationship with respect to one another. Similarly, reference point 865 has been moved from its position in FIG. 6 (reference point 665) to target position 520. Thus, reference point 865 and its corresponding group of MIDI events 822, 824 (and to a lesser extent, MIDI events 812, 814, 816, 826 and 828) are quantized to target position 520, but generally maintain their positional relationship with respect to one another. The quantization process shown in FIG. 8 is similar to the quantization process shown in FIG. 7, with the exception that the quantization strength is reduced by half. With a quantization strength of 100%, reference points are moved all the way to a corresponding target position. With a quantization strength of 50%, reference points are moved halfway to the corresponding target position. Setting different quantization strengths may be advantageous in different musical arrangements, as would be appreciated by one of ordinary skill in the art with the benefit of this disclosure.

Compression Algorithms

Figure 9:
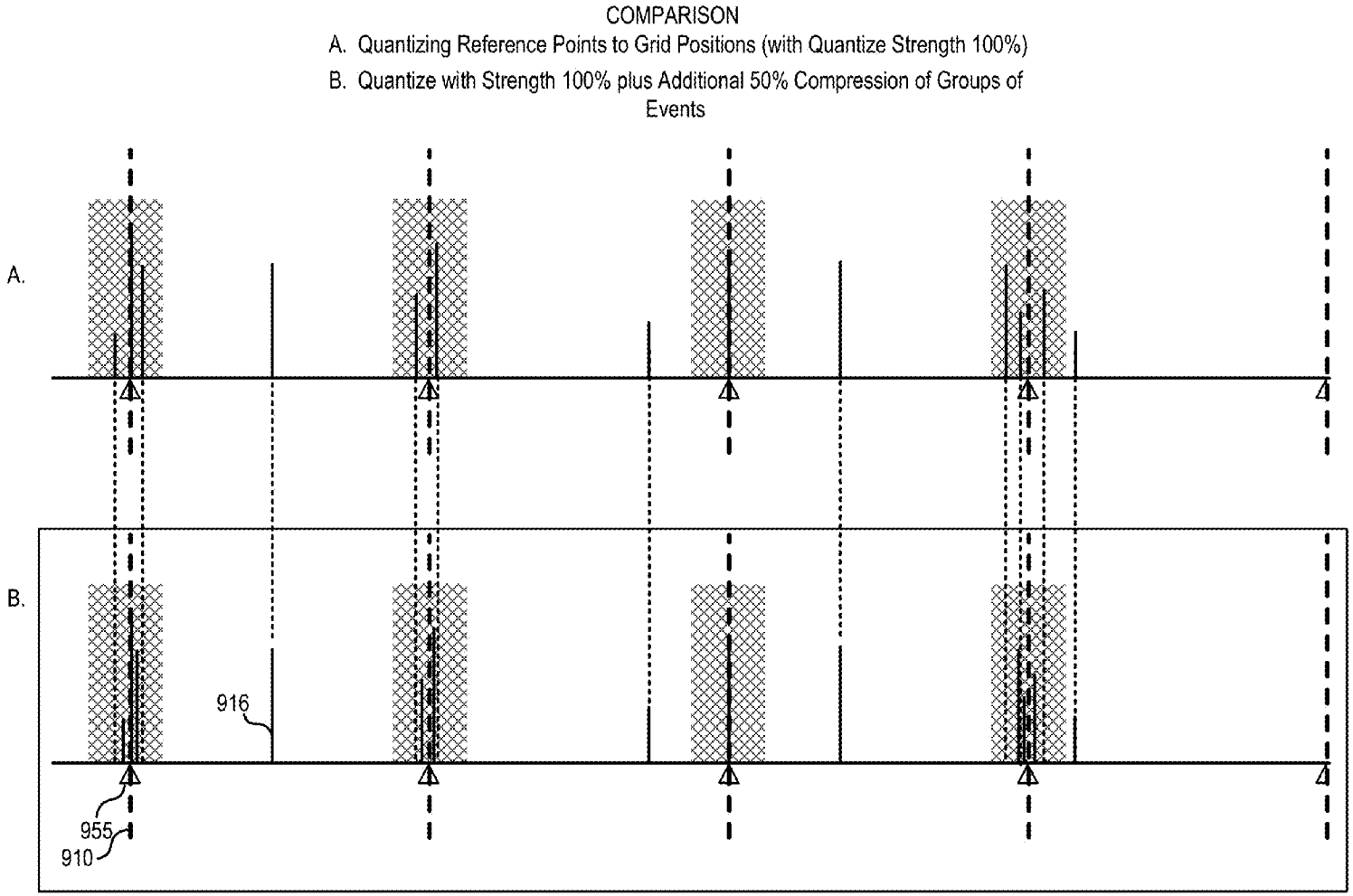
FIG. 9 illustrates certain aspects of quantizing and compressing groups of MIDI events in proportional quantization, according to certain embodiments of the invention.

FIG. 9 illustrates certain aspects of quantizing and compressing groups of MIDI events by using proportional quantization, according to certain embodiments of the invention. Compression schemes can be useful in some musical performances and may be used to adjust the relative spacing of the MIDI events within a quantization range. Positive compression will move MIDI events closer to each other. Negative compression will move MIDI events farther apart. The effects of compression as would be appreciated by one of ordinary skill in the art.

Timeline A is a reproduction of the resulting proportional quantization process shown in FIG. 7 with a quantization strength of 100%. Timeline B depicts the same resulting proportional quantization process corresponding to FIG. 7 with an additional 50% compression scheme. Timelines A and B are vertically aligned to more easily compare the differences between a proportional quantization scheme with and without a compression algorithm.

Referring to FIG. 9, the reference points are located in the same position along both timeline A and B. This is because the compression scheme affects the spacing of the notes with respect to one another in the group and not the quantization (i.e., movement) of the reference point itself. For example, reference point 955 is in the same position as reference point 755. This means that the group of MIDI events, as a whole, has been shifted the same amount. However, the spacing of the individual MIDI events themselves are closer together (i.e., compressed). Higher amounts of compression will move the MIDI events even closer together. Lower amounts of compression will compress the MIDI events by a smaller amount. These concepts apply to negative compression schemes as well.

In some embodiments, MIDI events positioned outside of any quantization range are not affected by the compression scheme. For example, MIDI event 916 is in the same position as MIDI event 716. Also, compression schemes may be applied to only certain quantization ranges, groups of MIDI events, or the like. For example, compression may be applied to one section of a musical performance, but not another section. The examples provided herein illustrate a compression scheme applied after a proportional quantization process is performed. Compression can be performed prior to quantization as well, which can have a different musical outcome, as would be appreciated by one of ordinary skill in the art with the benefit of this disclosure.

Figure 10:
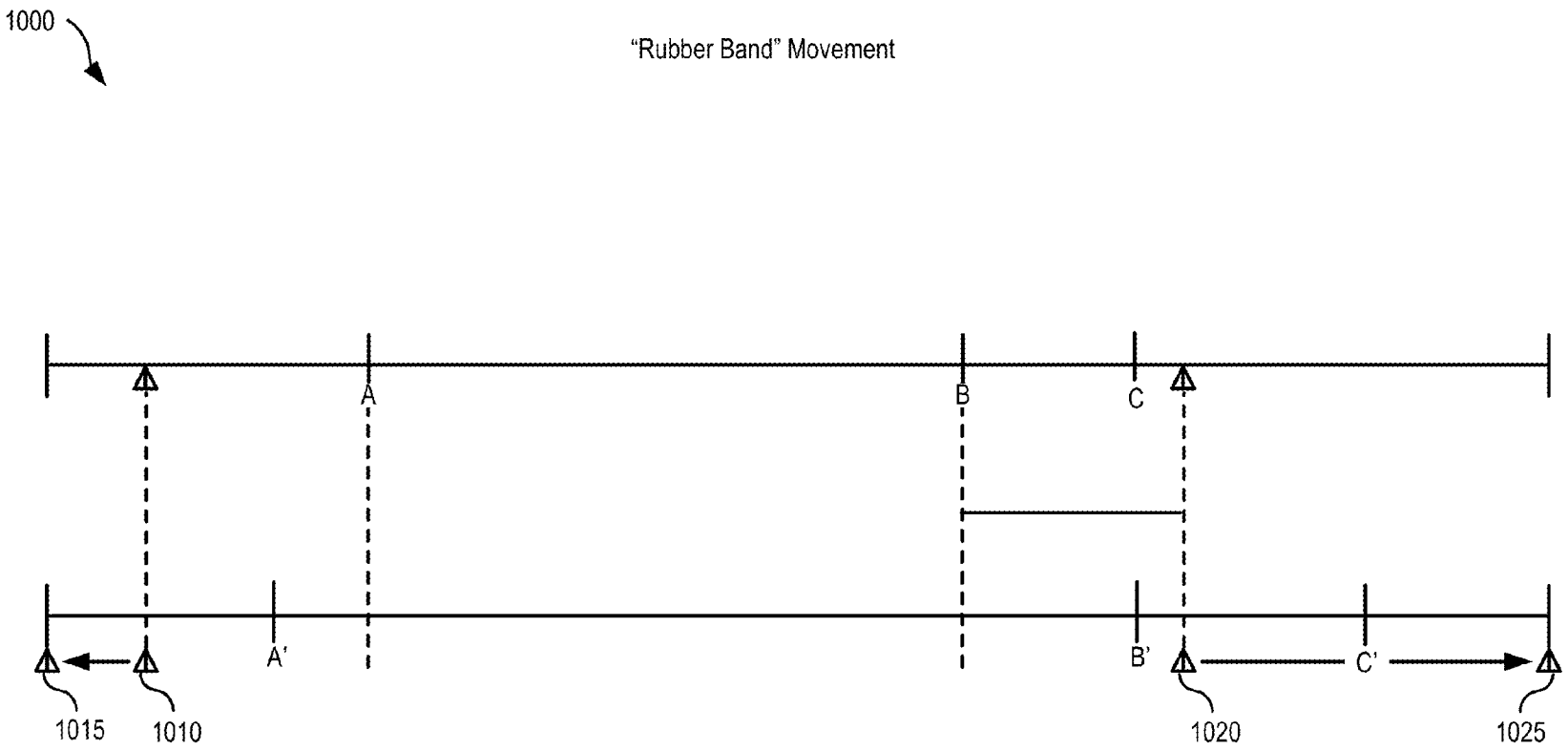
FIG. 10 depicts a simplified diagram illustrating aspects of proportional quantization, according to certain embodiments of the invention.

FIG. 10 depicts a simplified diagram illustrating aspects of proportional quantization, according to certain embodiments of the invention. Specifically, FIG. 10 depicts a simplified demonstration of how MIDI events are affected by proportional quantization. In summary, MIDI events will move proportionally towards adjacent target positions. In FIG. 10, reference point 1010 moves to position 1015, reference point 1020 moves to position 1025, point A moves to A', point B moves to B', and point C moves to C'. Since A is closer to reference point 1010 then reference point 1020, reference point 1010 has a stronger influence on A's movement. Likewise, since B and C are closer to reference point 1020 than reference point 1010, reference point 1020 has a stronger influence on B's and C's movement. In some embodiments, the closer the outside MIDI event is to the reference point, the stronger influence that reference point will have on the MIDI event.

Referring to FIG. 10, the movement from A to A' is commensurate with the movement of reference point 1010 to 1015 due, in part, to its proximity to reference point 1010, and the relatively long distance to reference point 1020. Therefore, reference point 1010 has a significantly greater influence on the movement of A. That is, based on the relative "strength" or influence of adjacent reference points and a MIDI event's location relative to those reference points, MIDI events are thereby moved proportionally. In some embodiments, Point A is ultimately moved a distance toward reference point 1015 that would be less than a MIDI event positioned closer to the reference point. In some embodiments, characteristics of the MIDI event itself may affect how much it moves towards its adjacent reference points. For example, MIDI events with very high velocities may not be as heavily influenced by reference point movement as MIDI events with very low velocities. Other characteristics can be used to influence the movement of individual MIDI events with respect to adjacent reference points, as would be appreciated by one of ordinary skill in the art with the benefit of this disclosure.

Point B is closer to reference 1020 than 1010, and point C is very closely positioned near reference 1020 and very far from reference 1010. Therefore, the quantization of reference 1020 will have a proportionally higher influence on B and C than reference 1010. Note that since C is closer to reference 1020 than B, it is more heavily influenced by it. As such, C to C' has a slightly larger displacement than B to B'. Neither movement can be equal to the displacement of reference 1020 because of the opposite influence of reference 1010.

In an effort to clarify this proportional quantization process, one can imagine that the timeline shown in FIG. 10 is a rubber band stretched taught with a paper clip on points A, B, and C. The ends of the rubber bands are at the reference points 1010 and 1020. As the reference points are moved or stretched to positions 1015 and 1025, respectively, one would expect that the paper clips would also move accordingly. If only one end (e.g., reference point) was moved or stretched, one would expect that paperclips closer to that reference point would move farther in the same direction as paperclips positioned farther from that reference point. That is, paper clips placed closer to a reference point would be displaced more than paperclips placed farther from the reference point. Similarly, if the opposite end (reference point) was stretched, one would expect paper clips closer to the reference point would move farther in the same directions as the reference point than paper clips farther away. If both ends (reference points) are stretched at the same time, then the paper clips would move proportionally toward one end or the other based on their relative position to each end (reference point). This tendency is shown in FIG. 10.

With respect to actual MIDI events, the proportional movement can depend not only to their proximity to the closest reference point, but also the relative "strength" of the reference points. For example, of one reference point is associated with a high number of high velocity MIDI events, and the second reference point is associated with only one low velocity MIDI event, then a MIDI event positioned equally between the two reference points would be more influenced by the first reference point with many high velocity MIDI events than the second reference points, and would move proportionally toward the first reference accordingly. Any number of factors including MIDI event location, MIDI characteristics, the magnitude of reference point movements, and any other suitable metric, can be used to determine how the proportional movement of MIDI events outside of quantization regions is affected and would be appreciated by one of ordinary skill in the art with the benefit of this disclosure.

Figure 11:
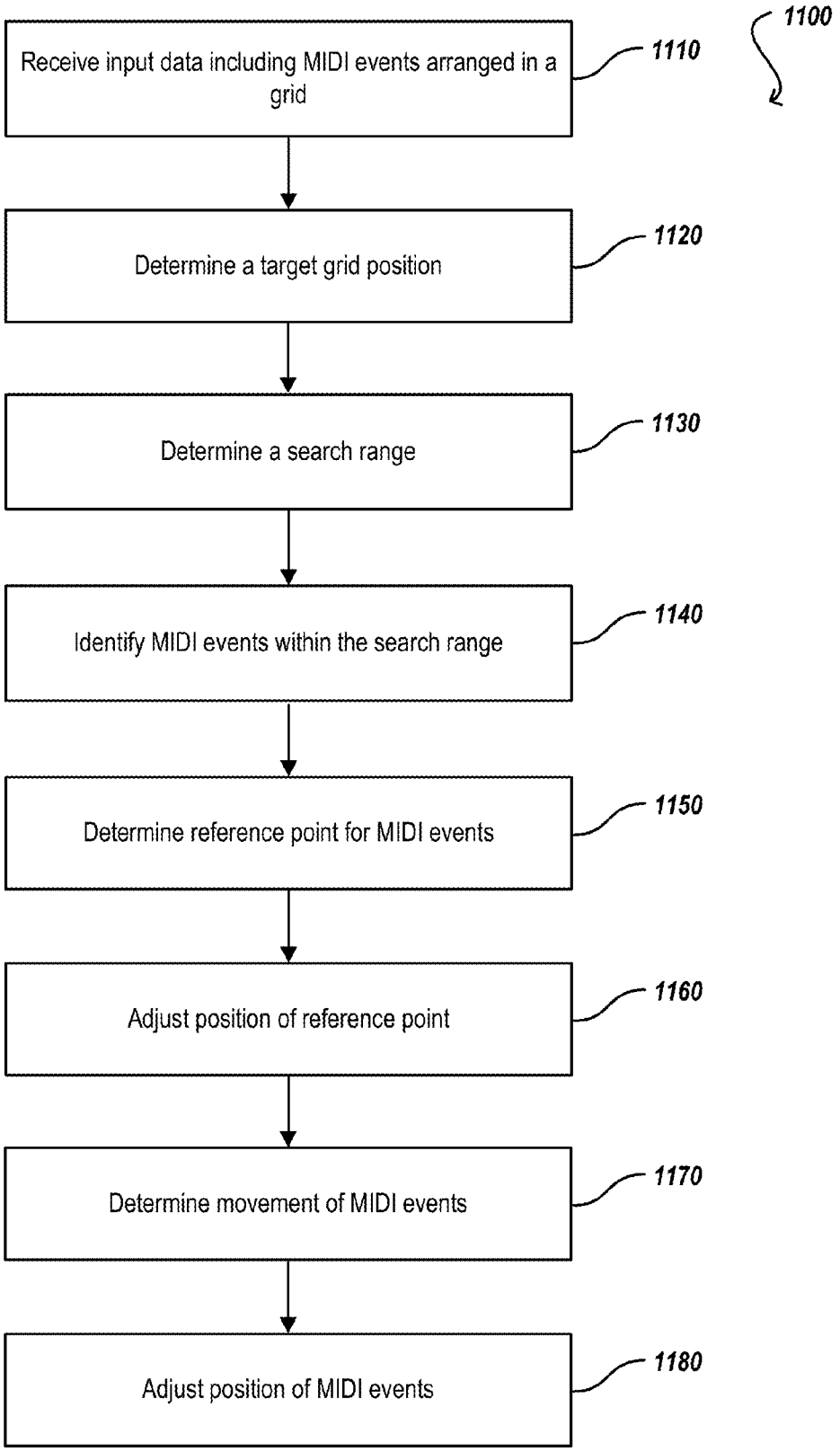
FIG. 11 is a simplified flow diagram illustrating aspects of proportional quantization, according to certain embodiments of the invention.

FIG. 11 is a simplified flow diagram illustrating aspects of a method 1100 of proportional quantization, according to certain embodiments of the invention. Method 1100 can be performed by processing logic that may comprise hardware (e.g., circuitry, dedicate logic, etc.), software (which as is run on a general purpose computing system or a dedicated machine), firmware (embedded software), or any combination thereof. In one embodiment, method 1100 is performed by aspects of system 1200 of FIG. 12 including processing unit 1210.

At 1110, method 1100 begins with receiving input data including MIDI events arranged in a grid, where the grid can have a plurality of grid positions, and the MIDI events have one or more MIDI characteristics. For example, MIDI events can be arranged in any suitable order (see, e.g., FIGS. 5-9) and in any grid format (see, e.g., FIG. 2). MIDI characteristics can include one or more of a MIDI event velocity, a MIDI event position relative to its corresponding reference point, a MIDI event amplitude, tone, effect, or any other suitable metric, as would be appreciated by one of ordinary skill in the art with the benefit of this disclosure. In one non-limiting example, input data can include MIDI events 508, 512, and 514 of FIG. 5.

At 1120, method 1100 includes determining a target grid position from among the plurality of grid positions. A target grid position is shown and described in FIG. 5 (target grid position 510, 520, 530, 540, 550). At 1130, method 1100 proceeds with determining a search range around the target grid position. The search range dictates how far a MIDI event can be from the target grid position to be included in the quantization process, as described above. For example, a search range 650 is shown in FIG. 6. The search range can be user-defined (i.e., entered by a user), a default search range, or an automatically adjusted search range. For instance, a system can determine a search range based on musical parameters such as tempo, MIDI event lengths (e.g., note lengths), MIDI event density (i.e., number of MIDI events in a given area), or any other suitable metric that could be used to define an appropriate range. In certain implementations, the method can include receiving range input data indicating the desired search range around the target grid position, and setting the search range according to the range input data. In some cases, multiple search range sizes for different target grid positions can be implemented.

At 1140, method 1100 includes identifying a set of MIDI events within the search range around the target grid position. That is, all of the MIDI events within a search range are identified. For example, MIDI events 508, 512, and 514 are located within search range 650 of FIG. 6. MIDI events 522 and 524 are located within search range 660. MIDI event 616, however, is not located within a search range. MIDI events that are not located within a search range can be referred to as an outlying MIDI event.

At 1150, method 1100 includes determining a reference point for the set of MIDI events. The reference point can correspond to a weighted average of the set of MIDI events within the search range, where the weighted average is based on one or more MIDI characteristics of the set of MIDI events within the search range. For example, reference point 655 represents the weighted average of MIDI events 508, 512, and 514. The weighted average may factor in one or more of a MIDI event's velocity, positional location, or other suitable metric, as would be appreciated by one of ordinary skill in the art with the benefit of this disclosure.

At 1160, method 1100 includes adjusting a position of the reference point toward the target grid position using a quantization strength. As described above, a quantization strength can control how much a reference point is moved during a quantization process. FIG. 7 illustrates a quantization process with 100% quantization strength, according to certain embodiments of the invention. FIG. 8 illustrates a quantization process with a 50% quantization strength, according to certain embodiments of the invention. Quantization strengths can be set to be uniform throughout a musical performance or portions thereof. In some cases, the quantization strength may vary at different points in a musical performance to achieve different effects, as would be appreciated by one of ordinary skill in the art.

At 1170, method 1100 includes determining a movement for the set of MIDI events using the reference point. At 1180, method 1100 includes proportionally adjusting a position of each of the MIDI events on the timeline, where each MIDI event in the set generally maintains a positional relationship with respect to each other MIDI event in the set as the position of the set is adjusted. In some embodiments, as the reference point is moved toward the target grid position, each of the MIDI events in the corresponding set of MIDI events are proportionally moved based on the movement of the reference point. That is, the positional relationship of the MIDI events with respect to one another remains intact (i.e., generally the same distance between adjacent MIDI events) while the group of MIDI events, as a whole, is shifted toward the target grid position, resulting in a quantized arrangement that maintains the musicality of the original performance. An example of this is shown process is shown in the transition between FIG. 5 (original performance) and FIG. 7 (100% quantization strength) or FIG. 8 (50% quantization strength).

It should be appreciated that the specific steps illustrated in FIG. 11 provide a particular method of proportional quantization, according to certain embodiments of the present invention. Other sequences of steps may also be performed according to alternative embodiments. For example, alternative embodiments of the present invention may perform the steps outlined above in a different order. Moreover, the individual steps illustrated in FIG. 11 may include multiple substeps that may be performed in various sequences as appropriate to the individual step. Furthermore, additional steps may be added or removed depending on the particular applications. One of ordinary skill in the art would recognize and appreciate many variations, modifications, and alternatives of method 1100.

As discussed above, method 1100 can be modified in any suitable manner, as would be appreciated by one of ordinary skill in the art with the benefit of this disclosure. For example, method 1100 can further include receiving quantization data indicating a desired quantization strength, and setting the quantization strength based on the quantization data. Method 1100 can further include determining a second target grid position, an associated search range, and a second set of MIDI events associated therein, determining a second reference point based on a weighted average of the second set of MIDI events, and adjusting a position of the second reference point and associated MIDI events in a similar fashion as discussed above in method step 1110-1170.

In some embodiments, method 1100 can include identifying an outlying MIDI event located outside of and between the first and second search ranges, determining a position of the outlying MIDI event, and adjusting the position of the outlying MIDI event using the first and second reference points. In some implementations, adjusting the position of the outlying MIDI event includes determining a distance of the outlying MIDI event with respect to the first reference point and second reference point, determining a strength of the weighted average for the first and second reference points, and adjusting the position of the outlying MIDI event based on its distance to the first and second reference points and the strength of the weighted average for the first and second reference points. The strength of the weighted average for each reference point can correspond to one or more of a number of MIDI events within the corresponding search range, and a velocity of the MIDI events within the corresponding search range. Other methods of determining the strength of a weighted average can be applied, as would be appreciated by one of ordinary skill in the art.

In some embodiments, method 1100 can further include receiving compression input data indicating an amount of compression to apply to the set of MIDI events within the search range, and compressing the set of MIDI events within the search range, where the MIDI events are moved relative to one another based on the sign and magnitude of the amount of compression specified in the compression input data.

System Architecture

Figure 12:
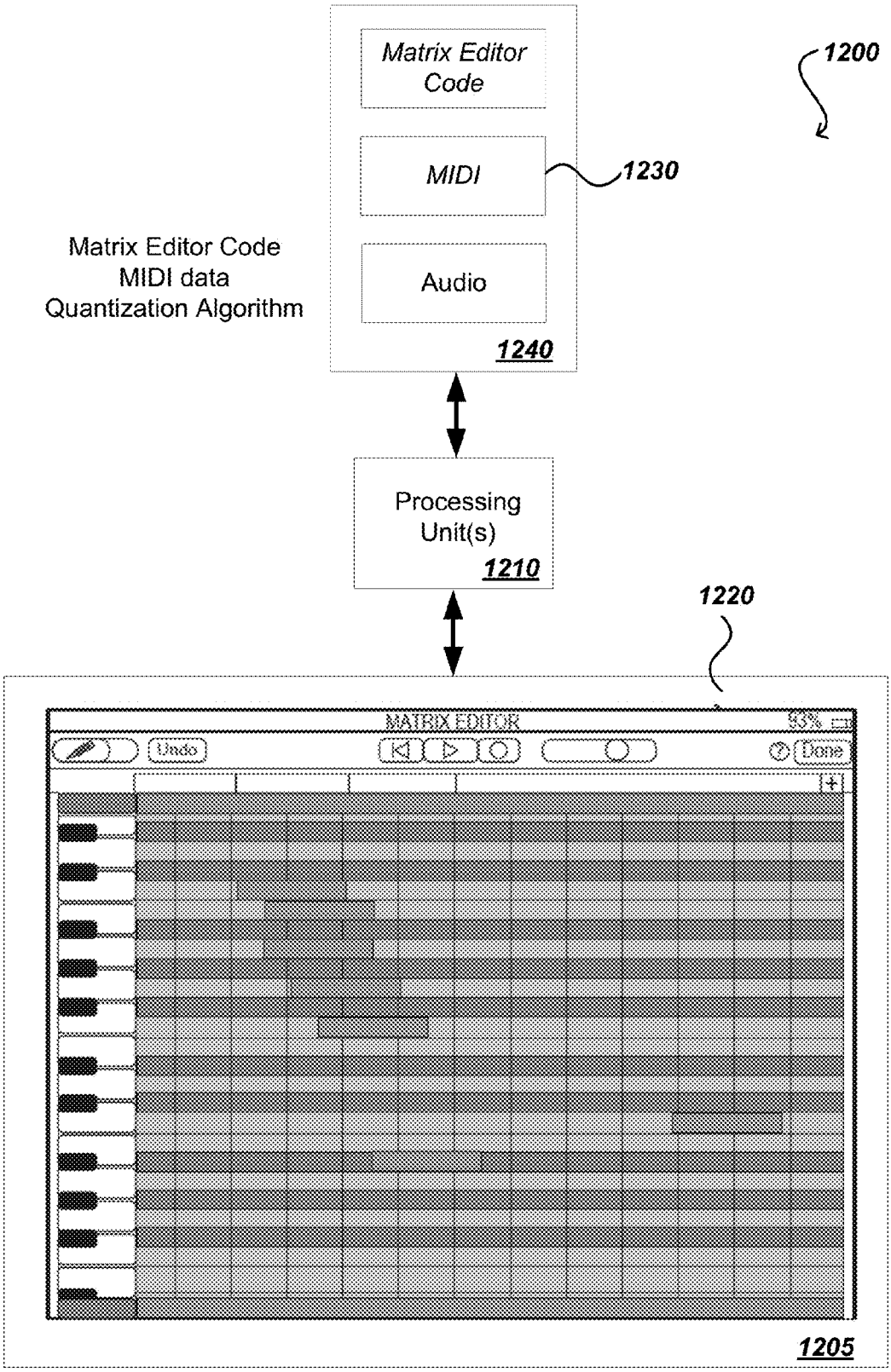
FIG. 12 illustrates an example of a system that can execute aspects of proportional quantization on a MIDI-based matrix editor, according to certain embodiments of the invention.

FIG. 12 illustrates an example of a system 1200 that can enable a user to proportionally quantize a musical performance, according to an embodiment of the invention. System 1200 can be a device that can include multiple subsystems such as a display subsystem 1205, one or more processors or processing units 1210, a storage subsystem 1240, and a communications system knot shown). One or more communication paths can be provided to enable one or more of the subsystems to communicate with and exchange data with one another. The various subsystems in FIG. 12 can be implemented in software, hardware, firmware, or combinations thereof. In some embodiments, the software can be stored on a transitory or non-transitory computer readable storage medium and can be executed by one or more processing units. In certain embodiments, storage subsystem 1240 comprises one or more memories for storing the data used or generated by certain embodiments of the present invention and for storing software (e.g., code, computer instructions) that may be executed by one or more processing units 1210.

It should be appreciated that system 1200 as shown in FIG. 12 can include more or fewer components than those shown in FIG. 12, can combine two or more components, or can have a different configuration or arrangement of components. In some embodiments, system 1200 can be a part of a portable computing device, such as a tablet computer, a mobile telephone, a smart phone, a desktop computer, a laptop computer, a kiosk, etc. The system 1200 can operate on an iPhone®, iPad®, iMac®, or the like.

In some embodiments, display subsystem 1205 can provide an interface that allows a user to interact with system 1200. The display subsystem 1205 may be a cathode ray tube (CRT), a flat-panel device such as a liquid crystal display (LCD), a projection device, a touch screen, or the like. In general, use of the term "output device" is intended to include all possible types of devices and mechanisms for outputting information from system 1200. For example, a software keyboard may be displayed using a flat-panel screen. In some embodiments, the display subsystem 1205 can be a touch interface, where the display provides both an interface for outputting information to a user of the device and also as an interface for receiving inputs. In other embodiments, there may be separate input and output subsystems. Through the display subsystem 1205, the user can view and interact with a GUI (Graphical User Interface) 1220 of a system 1200. In some embodiments, display subsystem 1205 can include a touch-sensitive interface (also sometimes referred to as a touch screen) that can both display information to the user and receive inputs from the user. Processing unit(s) 1210 can include one or more processors, each having one or more cores. In some embodiments, processing unit(s) 1210 can execute instructions stored in storage subsystem 1240. System 1200 can further include an audio system to play music (e.g., accompaniments, musical performances, etc.) through one or more audio speakers (not shown).

A communications system (not shown) can be implemented and in electronic communication with processing units 120. The communication system can include various hardware, firmware, and software components to enable electronic communication between multiple computing devices. A communications system or components thereof can communicate with other devices via Wi-Fi, Bluetooth, infra-red, or any other suitable communications protocol that can provide sufficiently fast and reliable data rates to support the real-time jam session functionality described herein. In some embodiments, the communications system can be integrated with another system level blocks, as would be appreciated by one of ordinary skill in the art.

Storage subsystem 1240 can include various memory units such as a system memory, a read only memory (ROM), and a non-volatile storage device (each not shown). The system memory can be a read and write memory device or a volatile read and write memory, such as dynamic random access memory. System memory can store some or all of the instructions and data that the processor(s) or processing unit(s) need at runtime. ROM can store static data and instructions that are used by processing unit(s) 1210 and other modules of system 1200. Non-volatile storage devices can be a read and write capable memory device. Embodiments of the invention can use a mass storage device (such as a magnetic or optical disk or flash memory) as a permanent storage device. Other embodiments can use a removable storage device (e.g., a floppy disk, a flash drive) as a non-volatile (e.g., permanent) storage device.

Storage subsystem 1240 can store MIDI (Musical Instrument Digital Interface) data relating to notes played on a virtual instrument of system 1200 in MIDI database 1230. The MIDI database 1230 can store performance data including velocity data, MIDI event data, rhythmic data, input data, compression data, quantization region data, or any other data, as previously described. Further detail regarding system architecture and the auxiliary components thereof (e.g., input/output controllers, memory controllers, etc.) are not discussed in detail so as not to obfuscate the focus on the invention and would be understood by those of ordinary skill in the art.

Figure 13:
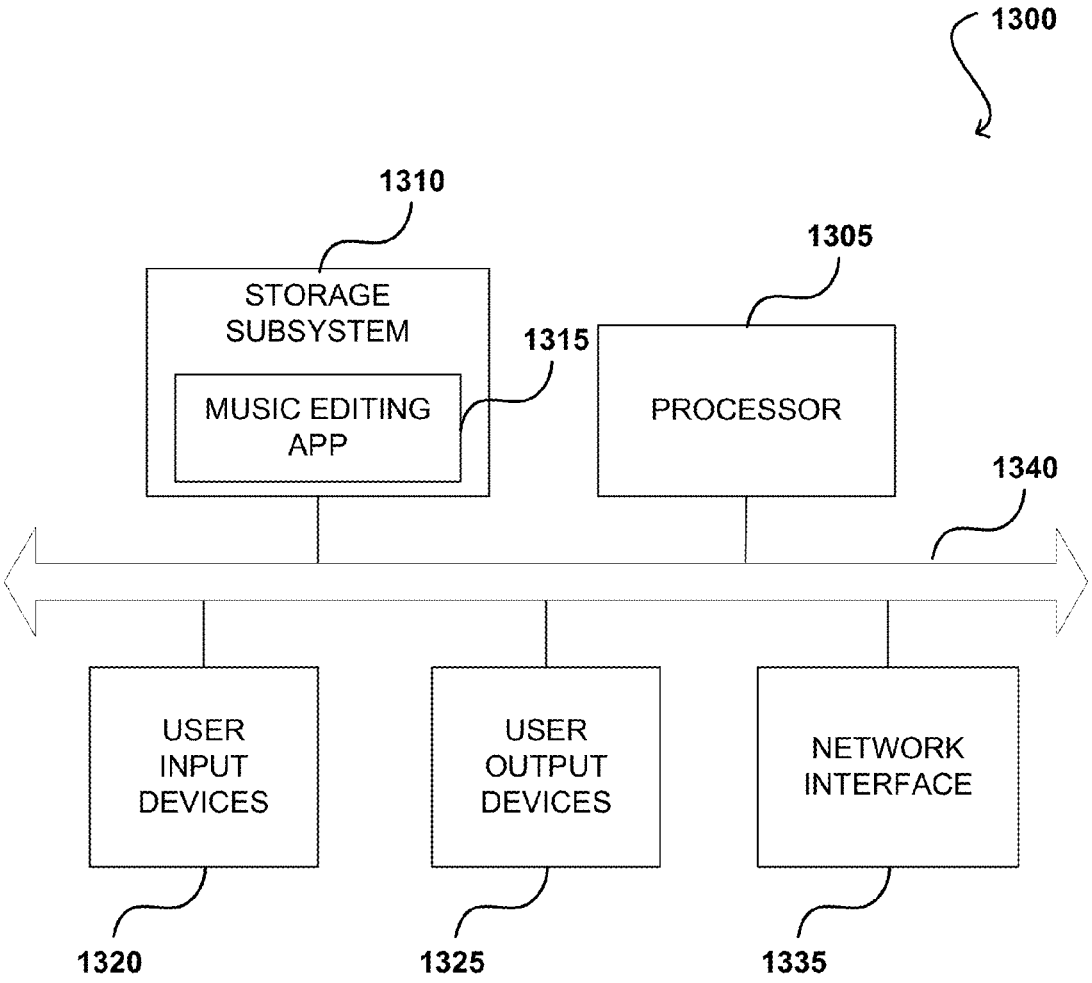
FIG. 13 illustrates an example of a computer system operable to run software configured for proportional quantization, according to certain embodiments of the invention.

FIG. 13 illustrates a computer system 1300 according to an embodiment of the present invention. Computer system 1300 can be implemented as any of various computing devices, including, e.g., a desktop or laptop computer, tablet computer, smart phone, personal data assistant (PDA), or any other type of computing device, not limited to any particular form factor. Computer system 1300 can include processing unit(s) 1305, storage subsystem 1310, input devices 1320, output devices 1325, network interface 1335, and bus 1340. In some embodiments, system 1300 can be operated in within the framework of Garageband® or Logic®, developed by Apple Computer®.

Processing unit(s) 1305 can include a single processor, which can have one or more cores, or multiple processors. In some embodiments, processing unit(s) 1305 can include a general purpose primary processor as well as one or more special purpose co-processors such as graphics processors, digital signal processors, or the like. In some embodiments, some or all processing units 1305 can be implemented using customized circuits, such as application specific integrated circuits (ASICs) or field programmable gate arrays (FPGAs). In some embodiments, such integrated circuits execute instructions that are stored on the circuit itself. In other embodiments, processing unit(s) 1305 can execute instructions stored in storage subsystem 1310.

Storage subsystem 1310 can include various memory units such as a system memory, a read-only memory (ROM), and a permanent storage device. The ROM can store static data and instructions that are needed by processing unit(s) 1305 and other modules of electronic device 1300. The permanent storage device can be a read-and-write memory device. This permanent storage device can be a non-volatile memory unit that stores instructions and data even when computer system 1300 is powered down. Some embodiments of the invention can use a mass-storage device (such as a magnetic or optical disk or flash memory) as a permanent storage device. Other embodiments can use a removable storage device (e.g., a floppy disk, a flash drive) as a permanent storage device. The system memory can be a read-and-write memory device or a volatile read-and-write memory, such as dynamic random access memory. The system memory can store some or all of the instructions and data that the processor needs at runtime.

Storage subsystem 1310 can include any combination of computer readable storage media including semiconductor memory chips of various types (DRAM, SRAM, SDRAM, flash memory, programmable read-only memory) and so on. Magnetic and/or optical disks can also be used. In some embodiments, storage subsystem 1310 can include removable storage media that can be readable and/or writeable; examples of such media include compact disc (CD), read-only digital versatile disc (e.g., DVD-ROM, dual-layer DVD-ROM), read-only and recordable Blue-Ray® disks, ultra density optical disks, flash memory cards (e.g., SD cards, mini-SD cards, micro-SD cards, etc.), magnetic "floppy" disks, and so on. The computer readable storage media do not include carrier waves and transitory electronic signals passing wirelessly or over wired connections.

In some embodiments, storage subsystem 1310 can store one or more software programs to be executed by processing unit(s) 1305, such as a user interface 1315. As mentioned, "software" can refer to sequences of instructions that, when executed by processing unit(s) 1305 cause computer system 1300 to perform various operations, thus defining one or more specific machine implementations that execute and perform the operations of the software programs. The instructions can be stored as firmware residing in read-only memory and/or applications stored in magnetic storage that can be read into memory for processing by a processor. Software can be implemented as a single program or a collection of separate programs or program modules that interact as desired. Programs and/or data can be stored in non-volatile storage and copied in whole or in part to volatile working memory during program execution. From storage subsystem 1310, processing unit(s) 1305 can retrieve program instructions to execute and data to process in order to execute various operations described herein.

A user interface can be provided by one or more user input devices 1320, display device 1325, and/or and one or more other user output devices (not shown). Input devices 1320 can include any device via which a user can provide signals to computing system 1300; computing system 1300 can interpret the signals as indicative of particular user requests or information. In various embodiments, input devices 1320 can include any or all of a keyboard touch pad, touch screen, mouse or other pointing device, scroll wheel, click wheel, dial, button, switch, keypad, microphone, and so on.

Output devices 1325 can display images generated by electronic device 1300. Output devices 1325 can include various image generation technologies, e.g., a cathode ray tube (CRT), liquid crystal display (LCD), light-emitting diode (LED) including organic light-emitting diodes (OLED), projection system, or the like, together with supporting electronics (e.g., digital-to-analog or analog-to-digital converters, signal processors, or the like), indicator lights, speakers, tactile "display" devices, headphone jacks, printers, and so on. Some embodiments can include a device such as a touchscreen that function as both input and output device.

In some embodiments, output device 1325 can provide a graphical user interface, in which visible image elements in certain areas of output device 1325 are defined as active elements or control elements that the user selects using user input devices 1320. For example, the user can manipulate a user input device to position an on-screen cursor or pointer over the control element, then click a button to indicate the selection. Alternatively, the user can touch the control element (e.g., with a finger or stylus) on a touchscreen device. In some embodiments, the user can speak one or more words associated with the control element (the word can be, e.g., a label on the element or a function associated with the element). In some embodiments, user gestures on a touch-sensitive device can be recognized and interpreted as input commands; these gestures can be but need not be associated with any particular array in output device 1325. Other user interfaces can also be implemented.

Network interface 1335 can provide voice and/or data communication capability for electronic device 1300. In some embodiments, network interface 1335 can include radio frequency (RF) transceiver components for accessing wireless voice and/or data networks (e.g., using cellular telephone technology, advanced data network technology such as 3G, 4G or EDGE, WiFi (IEEE 802.11 family standards, or other mobile communication technologies, or any combination thereof), GPS receiver components, and/or other components. In some embodiments, network interface 1335 can provide wired network connectivity (e.g., Ethernet) in addition to or instead of a wireless interface. Network interface 1335 can be implemented using a combination of hardware (e.g., antennas, modulators/demodulators, encoders/decoders, and other analog and/or digital signal processing circuits) and software components.

Bus 1340 can include various system, peripheral, and chipset buses that communicatively connect the numerous internal devices of electronic device 1300. For example, bus 1340 can communicatively couple processing unit(s) 1305 with storage subsystem 1310. Bus 1340 also connects to input devices 1320 and display 1325. Bus 1340 also couples electronic device 1300 to a network through network interface 1335. In this manner, electronic device 1300 can be a part of a network of multiple computer systems (e.g., a local area network (LAN), a wide area network (WAN), an Intranet, or a network of networks, such as the Internet. Any or all components of electronic device 1300 can be used in conjunction with the invention.

Some embodiments include electronic components, such as microprocessors, storage and memory that store computer program instructions in a computer readable storage medium. Many of the features described in this specification can be implemented as processes that are specified as a set of program instructions encoded on a computer readable storage medium. When these program instructions are executed by one or more processing units, they cause the processing unit(s) to perform various operation indicated in the program instructions. Examples of program instructions or computer code include machine code, such as is produced by a compiler, and files including higher-level code that are executed by a computer, an electronic component, or a microprocessor using an interpreter.

It will be appreciated that computer system 1300 is illustrative and that variations and modifications are possible. Computer system 1300 can have other capabilities not specifically described here (e.g., mobile phone, global positioning system (GPS), power management, one or more cameras, various connection ports for connecting external devices or accessories, etc.). Further, while computer system 1300 is described with reference to particular blocks, it is to be understood that these blocks are defined for convenience of description and are not intended to imply a particular physical arrangement of component parts. Further, the blocks need not correspond to physically distinct components. Blocks can be configured to perform various operations, e.g., by programming a processor or providing appropriate control circuitry, and various blocks might or might not be reconfigurable depending on how the initial configuration is obtained. Embodiments of the present invention can be realized in a variety of apparatus including electronic devices implemented using any combination of circuitry and software.

Figure 14:
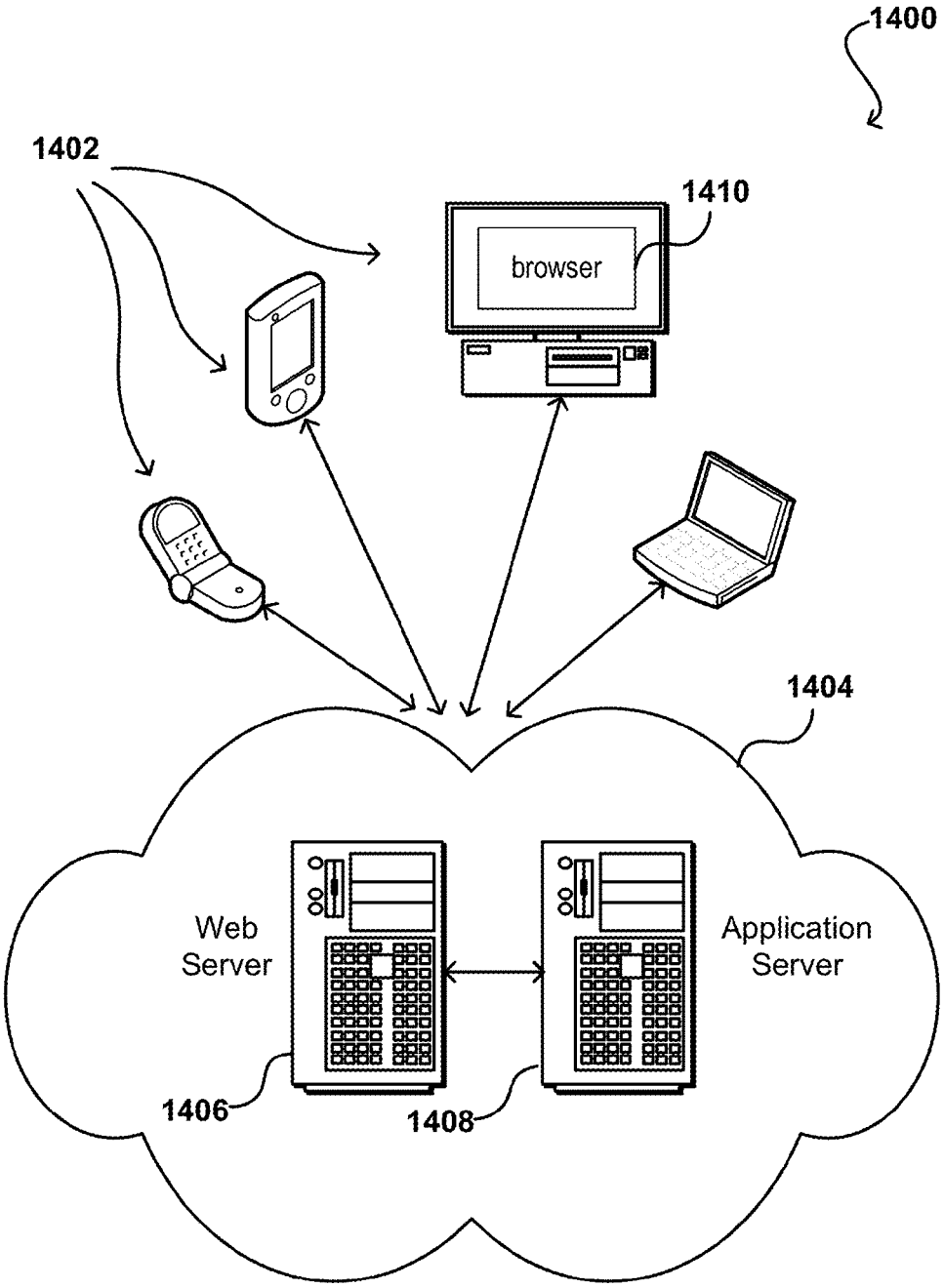
FIG. 14 illustrates a simplified diagram of a distributed system operable to perform aspects of proportional quantization, according to certain embodiments of the invention.

FIG. 14 depicts a simplified diagram of a distributed system 1400 for providing a system and method of proportional quantization, according to an embodiment of the invention. In the embodiment depicted in FIG. 14, system 1300 is provided on a server 1404 that is communicatively coupled with a remote client device 1402 via network 1406. Server 1404 may include one or more web servers 1408, application servers 1410, or a combination thereof, or any suitable server based infrastructure.

Network 1406 may include one or more communication networks, which could be the Internet, a local area network (LAN), a wide area network (WAN), a wireless or wired network, an Intranet, a private network, a public network, a switched network, or any other suitable communication network. Network 1406 may include many interconnected systems and communication links including but not restricted to hardwire links, optical links, satellite or other wireless communications links, wave propagation links, or any other ways for communication of information. Various communication protocols may be used to facilitate communication of information via network 1406, including but not restricted to TCP/IP, HTTP protocols, extensible markup language (XML), wireless application protocol (WAP), protocols under development by industry standard organizations, vendor-specific protocols, customized protocols, and others. In the configuration depicted in FIG. 14, aspects of system 1300 may be displayed by client device 1402.

In the configuration depicted in FIG. 14, system 1400 is remotely located from client device 1402. In some embodiments, server 1404 may operate the proportional quantization functions described herein. In some embodiments, the services provided by server 1404 may be offered as web-based or cloud services or under a Software-as-a-Service (SaaS) model.

It should be appreciated that various different distributed system configurations are possible, which may be different from distributed system 1400 depicted in FIG. 14. The embodiment shown in FIG. 14 is thus only one example of system for performing proportional quantization and is not intended to be limiting.

While the invention has been described with respect to specific embodiments, one skilled in the art will recognize that numerous modifications are possible. Thus, although the invention has been described with respect to specific embodiments, it will be appreciated that the invention is intended to cover all modifications and equivalents within the scope of the following claims.

The above disclosure provides examples and aspects relating to various embodiments within the scope of claims, appended hereto or later added in accordance with applicable law. However, these examples are not limiting as to how any disclosed aspect may be implemented, All the features disclosed in this specification (including any accompanying claims, abstract, and drawings) can be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, sixth paragraph. In particular, the use of "step of" in the claims herein is not intended to invoke the provisions of 35 U.S.C. §112, sixth paragraph.

What is claimed is:

1. A computer-implemented method comprising:

receiving input data including MIDI events arranged in a timeline, the timeline having a plurality of grid positions, the MIDI events having one or more MIDI characteristics;

determining a target grid position from among the plurality of grid positions;

determining a search range around the target grid position;

identifying a set of MIDI events within the search range around the target grid position;

applying an averaging function to the identified set of MIDI events;

determining a reference point for the set of MIDI events based on a result of the applied function;

adjusting a position of the reference point toward the target grid position;

determining a proportional movement for each MIDI event of the set if MIDI events on the timeline based on its location relative to the adjusted reference point; and adjusting each of the set of MIDI events based on the determined proportional movement.

2. The computer-implemented method of claim 1 wherein the function of the set of MIDI events is a weighted average based on one or more MIDI characteristics of the set of MIDI events.

3. The computer-implemented method of claim 2 wherein the MIDI characteristics include one or more of a MIDI event velocity and a MIDI event position relative to its corresponding reference point.

4. The method of claim 1 wherein the reference point is adjusted toward the target grid position based on a quantization strength.

5. The method of claim 4 further comprising:

receiving quantization data indicating a desired quantization strength; and setting the quantization strength based on the quantization data.

6. The computer-implemented method of claim 1 further comprising:

determining a second target grid position from among the plurality of grid positions;

determining a second search range around the second target grid position;

identifying a second set of MIDI events within the search range around the second target grid position, applying the averaging function to the identified second set of MIDI events;

determining a second reference point for the second set of MIDI events based on a result of the applied function to the second set of MIDI events; and adjusting a position of the second reference point toward the second target grid position, wherein determining a proportional movement for each MIDI event on the timeline is further based on its location relative to the second reference point.

7. The computer-implemented method of claim 1 further comprising:

receiving compression input data indicating an amount of compression to apply to the set of MIDI events within the search range; and compressing the set of MIDI events within the search range, wherein the MIDI events are moved relative to one another based on a sign and magnitude of the amount of compression specified in the compression input data.

8. A computer-implemented system comprising:

one or more processors; and one or more non-transitory computer-readable storage mediums containing instructions configured to cause the one or more processors to perform operations including:

receiving input data including MIDI events arranged in a timeline, the timeline having a plurality of grid positions, the MIDI events having one or more MIDI characteristics;

determining a target grid position from among the plurality of grid positions;

determining a search range around the target grid position;

identifying a set of MIDI events within the search range around the target grid position;

applying an averaging function to the identified set of MIDI events;

determining a reference point for the set of MIDI events based on a result of the applied function;

adjusting a position of the reference point toward the target grid position;

determining a proportional movement for each MIDI event of the set of MIDI events on the timeline based on its location relative to the adjusted reference point; and adjusting each of the set of MIDI events based on the determined proportional movement.

9. The system of claim 8 wherein the function of the set of MIDI events is a weighted average based on one or more MIDI characteristics of the set of MIDI events.

10. The system of claim 8 wherein the MIDI characteristics include one or more of a MIDI event velocity and a MIDI event position relative to its corresponding reference point.

11. The system of claim 8 wherein the reference point is adjusted toward the target grid position based on a quantization strength.

12. The system of claim 11 further comprising:

receiving quantization data indicating a desired quantization strength; and setting the quantization strength based on the quantization data.

13. The system of claim 8 further comprising:

determining a second target grid position from among the plurality of grid positions;

determining a second search range around the second target grid position;

identifying a second set of MIDI events within the search range around the second target grid position;

applying an averaging function to the identified second set of MIDI events;

determining a second reference point for the second set of MIDI events based on a result of the applied function to the second set of MIDI events; and adjusting a position of the second reference point toward the second target grid position, wherein determining a proportional movement for each MIDI event on the timeline is further based on its location relative to the second reference point.

14. The system of claim 8 further comprising:

receiving compression input data indicating an amount of compression to apply to the set of MIDI events within the search range; and compressing the set of MIDI events within the search range, wherein the MIDI events are moved relative to one another based on a sign and magnitude of the amount of compression specified in the compression input data.

15. A non-transitory computer-program product tangibly embodied in a machine-readable non-transitory storage medium, including instructions configured to cause a data processing apparatus to:

receive input data including MIDI events arranged in a timeline, the timeline having a plurality of grid positions, the MIDI events having one or more MIDI characteristics;

determine a target grid position from among the plurality of grid positions;

determine a search range around the target grid position;

identify a set of MIDI events within the search range around the target grid position;

applying an averaging function to the identified set of MIDI events;

determine a reference point for the set of MIDI events based on a result of the applied function;

adjust a position of the reference point toward the target grid position;

determine a proportional movement for each MIDI event of the set of MIDI events on the timeline based on its location relative to the adjusted reference point; and adjust each of the set of MIDI events based on the determined proportional movement.

16. The computer-program product of claim 15 wherein the function of the set of MIDI events is a weighted average based on one or more MIDI characteristics of the set of MIDI events.

17. The computer-program product of claim 15 wherein the MIDI characteristics include one or more of a MIDI event velocity and a MIDI event position relative to its corresponding reference point.

18. The computer-program product of claim 15 wherein the reference point is adjusted toward the target grid position based on a quantization strength.

19. The computer-program product of claim 15 further including instructions configured to cause the data processing apparatus to:

determine a second target grid position from among the plurality of grid positions;

determine a second search range around the second target grid position;

identify a second set of MIDI events within the search range around the second target grid position;

applying an averaging function to the identified second set of MIDI events;

determine a second reference point for the second set of MIDI events based on a result of the applied function to the second set of MIDI events; and adjust a position of the second reference point toward the second target grid position, wherein determining a proportional movement for each MIDI event on the timeline is further based on its location relative to the second reference point.

20. The computer-program product of claim 15 further including instructions configured to cause the data processing apparatus to:

receive compression input data indicating an amount of compression to apply to the set of MIDI events within the search range; and compress the set of MIDI events within the search range, wherein the MIDI events are moved relative to one another based on a sign and magnitude of the amount of compression specified in the compression input data.

* * * * *